US008588672B2

(12) United States Patent
Arai et al.

(10) Patent No.: US 8,588,672 B2
(45) Date of Patent: Nov. 19, 2013

(54) LUBRICANT APPLICATOR, PROCESS CARTRIDGE, TRANSFER UNIT, AND IMAGE FORMING APPARATUS

(75) Inventors: Yuji Arai, Kanagawa (JP); Ken Amemiya, Tokyo (JP); Satoshi Hatori, Kanagawa (JP); Toshio Koike, Tokyo (JP); Michiya Okamoto, Kanagawa (JP); Takuma Iwasaki, Kanagawa (JP); Hiroshi Mizusawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 288 days.

(21) Appl. No.: 13/067,024

(22) Filed: May 3, 2011

(65) Prior Publication Data

US 2011/0274474 A1 Nov. 10, 2011

(30) Foreign Application Priority Data

May 7, 2010 (JP) ..... 2010-107118

(51) Int. Cl.
*G03G 21/00* (2006.01)
*G03G 21/18* (2006.01)

(52) U.S. Cl.
USPC ..... 399/346; 399/101; 399/111

(58) Field of Classification Search
USPC ..... 399/346, 101, 111, 324, 325
See application file for complete search history.

(56) References Cited

U.S. PATENT DOCUMENTS

| | | | | |
|---|---|---|---|---|
| 6,160,977 | A * | 12/2000 | Takeichi et al. | 399/346 X |
| 6,330,420 | B1 * | 12/2001 | Honda | 399/346 |
| 6,885,842 | B2 * | 4/2005 | Sawai | 399/101 X |
| 2007/0068738 | A1 * | 3/2007 | Kawahara et al. | 184/99 |
| 2007/0122217 | A1 | 5/2007 | Nagashima et al. | |
| 2007/0209877 | A1 | 9/2007 | Arai et al. | |
| 2009/0010693 | A1 | 1/2009 | Hatori et al. | |
| 2009/0103944 | A1 | 4/2009 | Shintani et al. | |
| 2009/0241830 | A1 | 10/2009 | Koike et al. | |
| 2009/0252510 | A1 | 10/2009 | Shintani et al. | |
| 2010/0021205 | A1 | 1/2010 | Honjoh et al. | |
| 2011/0222938 | A1 * | 9/2011 | Watanabe et al. | 399/346 |

FOREIGN PATENT DOCUMENTS

| | | | |
|---|---|---|---|
| JP | 2000162881 | A | 6/2000 |
| JP | 2001356547 | A | 12/2001 |
| JP | 2006343623 | | 12/2006 |
| JP | 2007058169 | | 3/2007 |

* cited by examiner

*Primary Examiner* — Sophia S Chen
(74) *Attorney, Agent, or Firm* — Harness, Dickey & Pierce, P.L.C.

(57) ABSTRACT

A lubricant applicator includes a solid lubricant, a lubricant applying member to apply the solid lubricant to a target object, a biasing member to bias the solid lubricant toward the lubricant applying member, and a regulating member to regulate the solid lubricant, which is biased toward the lubricant applying member by the biasing member, to prevent the lubricant from separating from the lubricant applying member by more than a predetermined distance. The regulating member is switchable between a regulating state for regulating the solid lubricant not to separate from the lubricant applying member by more than the predetermined distance and a non-regulating state.

16 Claims, 11 Drawing Sheets

(a)

(b)

(a)

(b)

(a)

(b)

(c)

(d)

LUBRICANT APPLICATOR, PROCESS CARTRIDGE, TRANSFER UNIT, AND IMAGE FORMING APPARATUS

CROSS-REFERENCE TO RELATED APPLICATIONS

The present invention claims priority pursuant to 35 U.S.C. §119 from Japanese Patent Application No. 2010-107118, filed on May 7, 2010 in the Japan Patent Office, which is hereby incorporated by reference herein in its entirety.

BACKGROUND OF THE INVENTION

1. Field of the Invention

The present invention relates to an image forming apparatus, such as a copier, a facsimile machine, and a printer, and to a lubricant applicator, a process cartridge, and a transfer unit adopted in the image forming apparatus.

2. Description of the Related Art

To improve cleaning and transfer performance of a photoconductor or an intermediate transfer belt functioning as an image carrying member and prolong the life thereof, typically a lubricant applicator is used that applies lubricant to a surface of the image carrying member. In a typical configuration of the lubricant applicator, an application roller functioning as a lubricant applying member, such as a brush roller and a sponge roller, is rotatably provided such that the outer circumferential surface thereof is in uniform contact with the surface of the image carrying member. A solid lubricant, such as solidified zinc stearate, is biased against the application roller, and is brought into contact with the application roller with a predetermined pressure. A biasing member for biasing the solid lubricant toward the application roller uses, for example, the weight of the solid lubricant itself, a weight biasing the solid lubricant, or the resilience of a compressed spring. With this configuration, the application roller scrapes and applies the solid lubricant to the surface of the image carrying member as the image carrying member rotates.

In a new lubricant applicator having the above-described configuration, the force of the brush roller pushing back against the solid lubricant is relatively high due to, for example, the smooth surface of the solid lubricant at the beginning and relatively high resilience of bristles forming the brush roller. With the pressure applied by the biasing member alone, therefore, the solid lubricant fails to come into uniform contact with the brush roller, thereby limiting penetration of the solid lubricant into the brush roller. As a result, the area of contact between the solid lubricant and the brush roller is also reduced, reducing the amount of abrasion of the solid lubricant by the brush roller. In the initial stage of use of the lubricant applicator, therefore, the amount of the lubricant applied to the surface of the image carrying member is insufficient.

To prevent such a shortage of the lubricant application amount in the initial stage of use, it is conceivable to increase the pressure of the solid lubricant applied to the brush roller by the biasing member. If, the pressure applied by the biasing member is increased, however, the lubricant application amount is excessively increased as the area of contact is increased due to an increase over time in the amount of penetration of the solid lubricant into the brush roller. Consequently, accelerated consumption of the solid lubricant and cleaning failure occur in some cases.

In view of the above, the present applicant has proposed a lubricant applicator, in which the solid lubricant is reciprocally movable toward and away from the brush roller, and which includes regulating members for regulating the solid lubricant not to separate from the brush roller by more than a predetermined distance due to the force of the brush roller pushing back against the solid lubricant when the solid lubricant is biased toward the brush roller by the biasing member (JP-2007-058169-A). In the device, the regulating members prevent the solid lubricant from separating from the brush roller by more than the predetermined distance, forcing the solid lubricant constantly into the brush roller by at least a predetermined amount. Even in the initial stage of use of the device, therefore, the amount of abrasion of the solid lubricant is increased with at least a predetermined area of contact maintained between the solid lubricant and the brush roller, and the shortage of the amount of the solid lubricant applied to the image carrying member is prevented.

Further, as time elapses, the force of the brush roller pushing back against the solid lubricant is reduced. Thus, the solid lubricant is brought into uniform contact with the brush roller, increased in the area of contact thereof with the brush roller, and prevented from separating from the brush roller by more than the predetermined distance. In this state, regulation by the regulating members ends. Thus, the device switches to a state in which the solid lubricant is brought into contact with and scraped by the brush roller solely with the biasing performed by the biasing member. The biasing member is adjusted to bias the solid lubricant toward the brush roller with pressure for scraping an appropriate amount of the solid lubricant in a stable contact state with an increased contact area. Accordingly, the appropriate amount of the solid lubricant is stably applied over time.

Meanwhile, a new spare lubricant applicator may be installed in place for at least a few months to a year until actual use thereof. In the initial state of the lubricant applicator described above, the solid lubricant penetrates into the brush roller due to the forcible application of pressure by the regulating members. In the new spare lubricant applicator, therefore, the solid lubricant penetrating into the brush roller may be left standing for a long time. If the solid lubricant in such a state is left standing for a long time, bristles of the brush roller are flattened at a position at which the solid lubricant penetrates into the brush roller. When the new lubricant applicator starts being used in place of the old device, therefore, an abnormal image may be generated in the form of banding, for example, that is caused by uneven rotation of the brush roller.

The occurrence of the above-described phenomenon is not limited to prolonged exposure without use of the new lubricant applicator. The phenomenon may also occur when the new lubricant applicator is used for only a short time after installation thereof and thereafter left standing for along time without being actuated, or when the lubricant applicator is detached and left standing. This is because the flattening of the bristles of the brush roller similarly occurs when the lubricant applicator is left standing for a long time in the initial stage of use, in which the regulating members forcibly apply the pressure of the solid lubricant to the brush roller.

The above phenomenon has been described in terms of the flattening of the bristles of the brush roller as the deformation of the lubricant applying member. However, the deformation is not limited thereto. A similar phenomenon occurs when a sponge roller is used as the lubricant applying member. That is, the sponge roller deforms in the area of contact thereof with the solid lubricant forcibly applied with pressure by the regulating members, when the lubricant applicator is left standing for a long time before use or in the initial stage of use thereof.

SUMMARY OF THE INVENTION

The present invention describes a novel lubricant applicator. In one example, a novel lubricant applicator includes a solid lubricant, a lubricant applying member to apply the solid lubricant to a target object, a biasing member to bias the solid lubricant toward the lubricant applying member, and a regulating member to regulate the solid lubricant, which is biased toward the lubricant applying member by the biasing member, to prevent the lubricant from separating from the lubricant applying member by more than a predetermined distance. The regulating member is switchable between a regulating state for regulating the solid lubricant not to separate from the lubricant applying member by more than the predetermined distance and a non-regulating state.

The above-described lubricant applicator may further include a lubricant holding member to hold the solid lubricant. In the above-described lubricant applicator, the regulating member may switch to the regulating state by pressing the solid lubricant or the lubricant holding member, and the regulating member may switch to the non-regulating state in accordance with a reduction in pressing force of the regulating member below the pressing force exerted in the regulating state.

The above-described lubricant applicator may further include a lubricant holding member to hold the solid lubricant. In the above-described lubricant applicator, the regulating member may switch to the regulating state by coming into contact with the solid lubricant or the lubricant holding member, and the regulating member may switch to the non-regulating state by separating from the solid lubricant or the lubricant holding member.

The above-described lubricant applicator may further include a projecting switch projecting from the lubricant applicator, and a stopper. In the above-described lubricant applicator, the regulating member may be switched externally between the regulating state and the non-regulating state.

The above-described lubricant applicator may be removably installed in the image forming apparatus with the regulating member in the regulating state.

In the non-regulating state of the regulating member of the lubricant applicator, the installation of the lubricant applicator into the image forming apparatus may be prohibited.

The regulating member may switch from the non-regulating state to the regulating state upon installation of the lubricant applicator in the image forming apparatus.

The solid lubricant may include zinc stearate.

The above-described lubricant applicator may further include a housing, and the regulating member may form a lubricant case which stores the solid lubricant and the biasing member, and which is removably installable in the housing of the lubricant applicator.

The present invention further describes a novel image forming apparatus. In one example, the novel image forming apparatus includes multiple image carrying members corresponding to carry the electrostatic latent images formed on respective surfaces thereof, a latent image forming device corresponding to the multiple color image carrying members, to form electrostatic latent images on the respective surfaces of the multiple image carrying members, multiple development devices corresponding to the multiple color image carrying members, to develop the electrostatic latent images into toner images of multiple colors, a transfer device to transfer the toner images of the multiple colors onto a recording medium, and multiple lubricant applicators according to claim 9, corresponding to the multiple color image carrying members, to apply the lubricant to respective surfaces of the image carrying members. Upon installation of the lubricant applicators in the image forming apparatus, the fixing position of the regulating member of at least one of the lubricant applicators may be different between that of the other lubricant applicators.

The present invention further describes a novel lubricant applicator in which the lubricant applying member may be a brush.

The present invention further describes a novel lubricant applicator in which the lubricant applying member may be a sponge.

The present invention further describes a novel process cartridge. In one example, a process cartridge is removably installable in an image forming apparatus and includes an image carrying member to carry a toner image formed thereon, at least one of a charging device, a cleaning device, and a development device formed integrally with the image carrying member, and the above-described lubricant applicator to apply the lubricant to a surface of the image carrying member.

The present invention further describes a novel transfer unit. In one example, the novel transfer unit includes a transfer device to transfer a toner image formed on an image carrying member, a transfer member to carry the toner image transferred thereto, and the above-described lubricant applicator to apply the lubricant to a surface of the transfer member.

The present invention further describes a novel image forming apparatus. In one example, the novel image forming apparatus includes an image carrying member to carry an electrostatic latent image formed on a surface thereof, a latent image forming device to form the electrostatic latent image on the surface of the image carrying member, a development device to develop the electrostatic latent image into a toner image, a transfer device to transfer the toner image onto a recording medium, and the above-described transfer unit.

The present invention further describes a novel image forming apparatus. In one example, the novel image forming apparatus includes an image carrying member to carry an electrostatic latent image formed on a surface thereof, a latent image forming device to form the electrostatic latent image on the surface of the image carrying member, a development device to develop the electrostatic latent image into a toner image, a transfer device to transfer the toner image onto a recording medium, and the above-described lubricant applicator, to apply the lubricant to a surface of the image carrying member.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
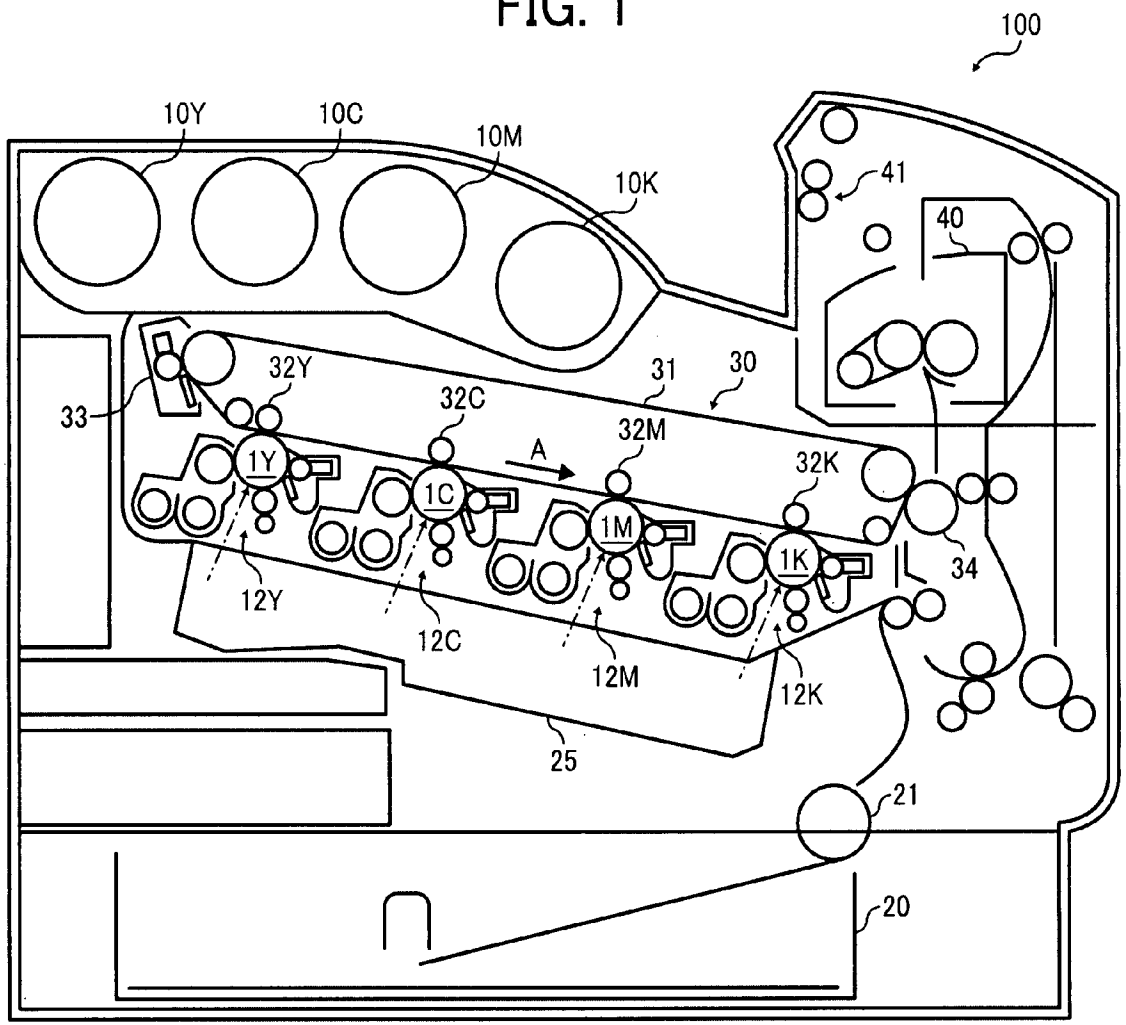
FIG. 1 is a schematic diagram of an image forming apparatus according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, an image forming apparatus 100 according to an embodiment of the present invention will be described. A configuration and operation of the image forming apparatus 100 according to the present embodiment will be first described.

FIG. 1 is a schematic configuration diagram illustrating the entirety of the image forming apparatus 100 according to the present embodiment. The image forming apparatus 100 of FIG. 1 is a color image forming apparatus which forms one image by using toners of four colors of yellow, cyan, magenta, and black (hereinafter referred to as Y, C, M, and K, respectively). The image forming apparatus 100 includes four image forming units 12Y, 12C, 12M, and 12K for forming images of the respective colors, which are arranged along an intermediate transfer belt 31 having an outer circumferential surface moving in the direction indicated by an arrow A in the drawing. The image forming units 12Y, 12C, 12M, and 12K include photoconductors 1Y, 1C, 1M, and 1K, respectively, those serve as image carrying members.

Inside the intermediate transfer belt 31 that serves as a transfer member, primary transfer rollers 32Y, 32C, 32M, and 32K are provided to serve as a transfer device to transfer toner images onto the intermediate transfer belt 31 from the photoconductors 1Y, 1C, 1M, and 1K, respectively. On the downstream side of the primary transfer rollers 32Y, 32C, 32M, and 32K in the rotation direction of the intermediate transfer belt 31, a secondary transfer roller 34 is provided to face the surface of the intermediate transfer belt 31. Further, on the downstream side of the secondary transfer roller 34, an intermediate transfer belt cleaning device 33 is provided which cleans the surface of the intermediate transfer belt 31 after the transfer of the toner images. In the image forming apparatus 100 according to the present embodiment, the above-described components integrally form a transfer unit 30 removably installable in the image forming apparatus 100.

Below the four image forming units 12Y, 12C, 12M, and 12K, an exposure device 25 that serves as a latent image forming device is provided. Below the exposure device 25, a sheet feeding cassette 20 for storing a transfer sheet functioning as a recording medium and a sheet feeding device 21 are provided. Further, above the secondary transfer roller 34, a fixing device 40 for fixing an image on the transfer sheet and sheet discharging rollers 41 are provided. FIG. 1 also illustrates toner bottles 10Y, 10C, 10M, and 10K containing the toners of the yellow, cyan, magenta, and black colors, respectively.

Figure 2:
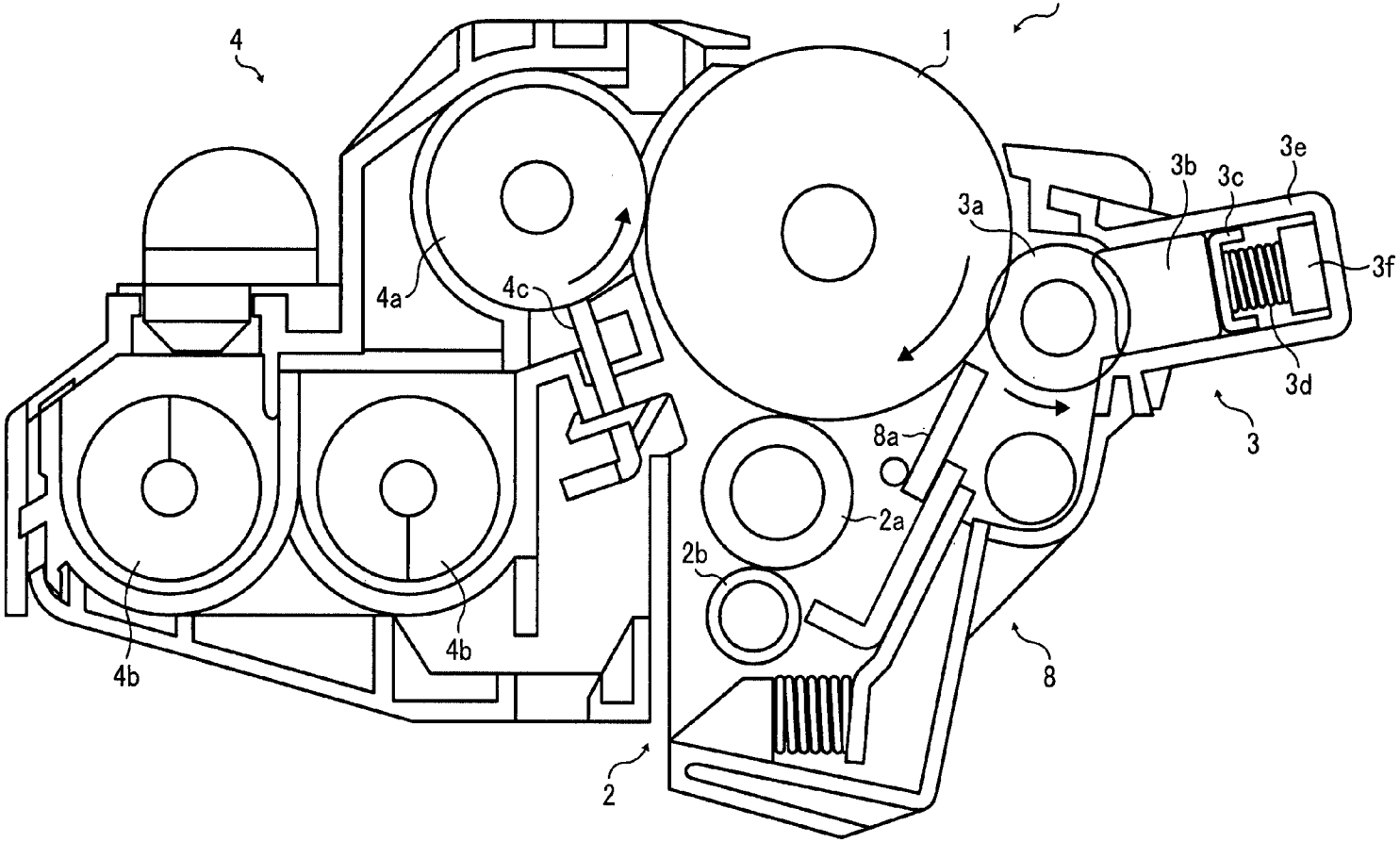
FIG. 2 is a configuration diagram of an image forming unit adopted in the image forming apparatus according to the embodiment of the present invention.

FIG. 2 is a schematic configuration diagram illustrating one of the image forming units 12Y, 12C, 12M, and 12K. The four image forming units 12Y, 12C, 12M, and 12K are substantially the same in configuration, except that toners of different colors are contained therein. In the following, therefore, description will be made with the suffixes Y, C, M, and K omitted. In the image forming unit 12, the photoconductor 1 is surrounded by a charging device 2 for supplying charge to the outer circumferential surface of the photoconductor 1, a development device 4 for developing an electrostatic latent image formed on the surface of the photoconductor 1 into a toner image by using the toner of the corresponding color, a lubricant applicator 3 for applying lubricant to the surface of the photoconductor 1, and a cleaning device 8 for cleaning the surface of the photoconductor 1 after the transfer of the toner image. The charging device 2 includes a charging roller 2*a* functioning as a charging member and a charging roller cleaning member 2*b* for cleaning the outer circumferential surface of the charging roller 2*a*. The charging roller 2*a* is formed by a conductive rotary shaft, the outer circumferential surface of which is provided with a surface layer made of a conductive resin or rubber. The charging roller 2*a* uniformly charges the surface of the photoconductor 1 by applying thereto a voltage from a not-illustrated high-voltage power supply for charging, which is connected to the rotary shaft. The development device 4 includes developer containers 4*b* for containing a developer, a development roller 4*a* functioning as a developer carrying member arranged in the vicinity of the surface of the photoconductor 1 to face the surface, and a developer regulating member 4*c* for regulating the amount of the developer carried on the development roller 4*a*. The development roller 4*a* carries and conveys the developer to a position facing the photoconductor 1 and supply the toner to the electrostatic latent image formed on the photoconductor 1 to thereby develop the electrostatic latent image. The lubricant applicator 3 includes a brush roller 3*a*, a solid lubricant 3*b*, a lubricant holding member 3*c*, multiple compressed springs 3*d*, a housing 3*e*, and regulating members 3*f*. The cleaning device 8 includes a cleaning blade 8*a* which comes into contact with the surface of the photoconductor 1 and scrapes post-transfer residual toner off the surface. In the image forming apparatus 100 according to the present embodiment, the image forming unit 12 integrally forms a process cartridge removably installable in the image forming apparatus 100.

Subsequently, the operation of the image forming apparatus 100 will be described. Upon receipt of a signal for starting an image forming operation, the surface of the intermediate transfer belt 31 starts moving. At the same time, in the image forming unit 12Y, the surface of the photoconductor 1Y is uniformly charged by the charging device 2Y, and is applied with laser light by the exposure device 25. Thereby, an electrostatic latent image is formed. The electrostatic latent image is developed by the development device 4Y. Thereby, a yellow toner image is formed on the surface of the photoconductor 1Y. In a similar manner, cyan, magenta, and black toner images are formed on the photoconductors 1C, 1M, and 1K in the image forming units 12C, 12M, and 12K, respectively. Along with the movement of the surface of the intermediate transfer belt 31, the toner images of the respective colors are sequentially transferred onto the surface of the intermediate transfer belt 31 by the primary transfer rollers 32Y, 32C, 32M, and 32K. Thereby, a composite color image is formed on the intermediate transfer belt 31. The operations of forming the images of the respective colors are performed with the operation timing shifted from the upstream side to the downstream side such that the toner images are transferred as superimposed upon one another at the same position on the intermediate transfer belt 31.

Meanwhile, a transfer sheet is fed from the sheet feeding cassette 20 by the sheet feeding device 21, and is conveyed to a nip portion formed by the intermediate transfer belt 31 and the secondary transfer roller 34. Then, the composite color image on the intermediate transfer belt 31 is transferred onto the transfer sheet by the secondary transfer roller 34. Thereby, the color image is recorded on the transfer sheet. After the transfer of the image, the transfer sheet is conveyed to the fixing device 40, and the image transferred to the transfer sheet is fixed thereon. Thereafter, the transfer sheet is discharged outside the image forming apparatus 100 by the sheet discharging rollers 41. Further, residual toners remaining on the photoconductors 1Y, 1C, 1M, and 1K after the transfer of the toner images are cleaned off by the respective cleaning devices 8Y, 8C, 8M, and 8K. Further, residual toner remaining on the intermediate transfer belt 31 after the transfer of the toner image is cleaned off by the intermediate transfer belt cleaning device 33. The waste toners are discharged into a not-illustrated waste toner bottle provided in the image forming apparatus 100 by not-illustrated waste toner conveying screws respectively included in the cleaning devices 8Y, 8C, 8M, and 8K and the intermediate transfer belt cleaning device 33.

Further, each of the development devices 4Y, 4C, 4M, and 4K for the respective colors having consumed the toner in the image forming operation is refilled with a predetermined refill amount of the toner through a not-illustrated conveying path from the corresponding one of the toner bottles 10Y, 10C, 10M, and 10K in the upper-left side of FIG. 1, which are filled with the toners of the yellow, cyan, magenta, and black colors, respectively.

In the above-described image forming apparatus 100, the lubricant applicators 3Y, 3C, 3M, and 3K (hereinafter referred to as the lubricant applicators 3) are provided to improve the cleaning performance of the photoconductors 1Y, 1C, 1M, and 1K, increase the life thereof, and improve the transfer performance thereof against, for example, a worm-hole phenomenon (i.e., local omission of image) occurring in the image transfer process. In the following, embodiments of the lubricant applicators 3 included in the image forming apparatus 100 according to the present embodiment will be described in detail.

Embodiment 1

Embodiment 1 of the lubricant applicator 3 included in the image forming apparatus 100 according to the present embodiment will be first described.

Figure 3:
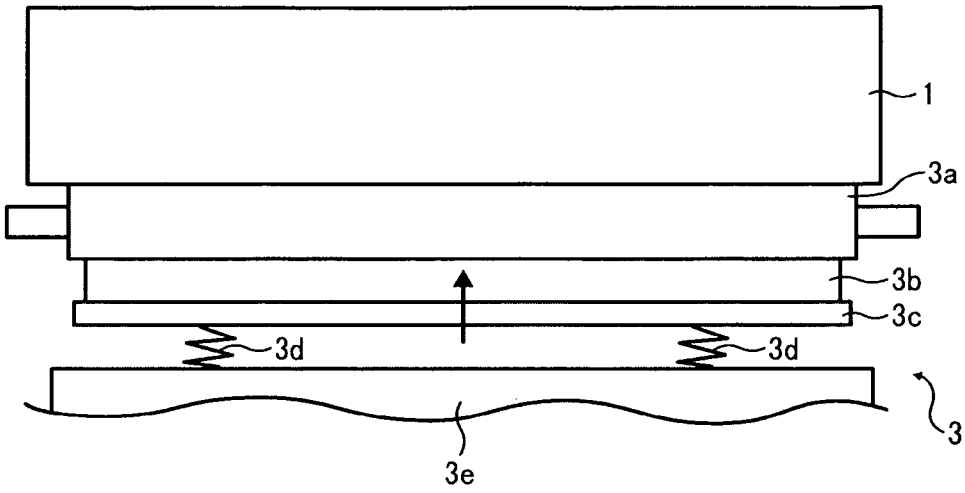
FIGS. 3(*a*) and 3(*b*) are schematic configuration diagrams of Embodiment 1 of a lubricant applicator included in the image forming apparatus according to the embodiment of the present invention.
Figure 3:
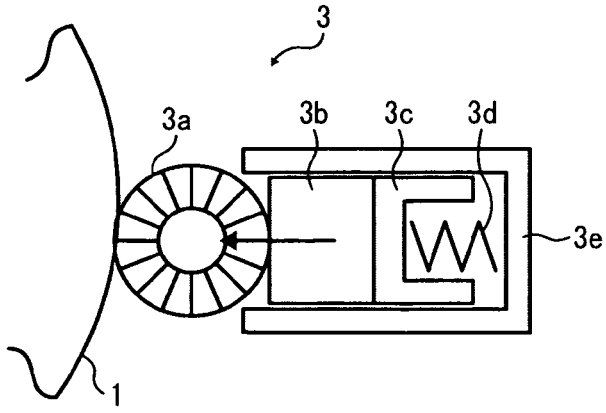

FIGS. 3(*a*) and 3(*b*) are schematic configuration diagrams of the lubricant applicator 3. FIG. 3(*a*) is a top view of the lubricant applicator 3 taken along the long side thereof. FIG. 3(*b*) is a cross-sectional view of the lubricant applicator 3 taken along the short side thereof. The lubricant applicator 3 includes the brush roller 3*a* that serves as a lubricant applying member, the solid lubricant 3*b*, the lubricant holding member 3*c* that serves as a lubricant holding member, the multiple compressed springs 3*d* that serves as a biasing member, and the housing 3*e*. The housing 3*e* is fixed to the image forming unit 12, and stores the brush roller 3*a*, the solid lubricant 3*b*, the lubricant holding member 3*c*, and the compressed springs 3*d*. The brush roller 3*a* is arranged with the outer circumferential surface thereof in uniform contact with the surface of the photoconductor 1, and functions as a lubricant applying member. The solid lubricant 3*b* comes into contact with the brush roller 3*a*. The lubricant holding member 3*c* supports the solid lubricant 3*b*. The compressed springs 3*d* function as a biasing member for pressing the solid lubricant 3*b* against the brush roller 3*a* via the lubricant holding member 3*c*. It should be noted that instead of the illustrated brush roller 3*a* a sponge roller may be used as the lubricant applying member. In addition, instead of the illustrated compressed springs 3*d*, a weight or the like may be used as the biasing member to apply pressure in a vertical direction.

A fatty acid metal salt, fluorine contained resin, and so forth may be used to form the solid lubricant 3*b*. In particular, a fatty acid metal salt is preferable. The fatty acid of the fatty acid metal salt includes straight-chain hydrocarbon, such as myristic acid, palmitic acid, stearic acid, and oleic acid. As the metal of the fatty acid metal salt, lithium, magnesium, calcium, strontium, zinc, cadmium, aluminum, cerium, titanium, magnesium stearate, aluminum stearate, and iron stearate are preferable. In particular, zinc stearate is preferable. The solid lubricant 3*b*, made of such a fatty acid metal salt molded into a rectangular parallelepiped shape, is fixed to the lubricant holding member 3*c* by double-sided adhesive tape or an adhesive agent.

The lubricant holding member 3*c* is held by the housing 3*e* via the multiple compressed springs 3*d*. The solid lubricant 3*b* held by the lubricant holding member 3*c* is movable in the directions of coming into contact with and separating from the brush roller 3*a*. The solid lubricant 3*b* is biased in the direction indicated by an arrow in FIGS. 3(*a*) and 3(*b*) by the multiple compressed springs 3*d* via the lubricant holding member 3*c*. Thereby, the solid lubricant 3*b* is brought into contact with the brush roller 3*a* with predetermined pressure. Along with the rotation of the brush roller 3*a*, the brush roller 3*a* scrapes and applies the solid lubricant 3*b* to the surface of the photoconductor 1.

In the initial stage of use of the lubricant applicator 3, however, the biasing by the compressed springs 3*d* alone is insufficient. Thus, the force of the brush roller 3*a* pushing back against the solid lubricant 3*b* is relatively high due to the surface characteristics of the solid lubricant 3*b* and the resilience of the fiber forming the brush roller 3*a*. Therefore, the solid lubricant 3*b* fails to come into uniform contact with the brush roller 3*a*, and the area of contact thereof with the brush roller 3*a* is reduced. As a result, the amount of abrasion of the solid lubricant 3*b* is reduced, and a sufficient lubricant application amount is not obtained.

Figure 4:
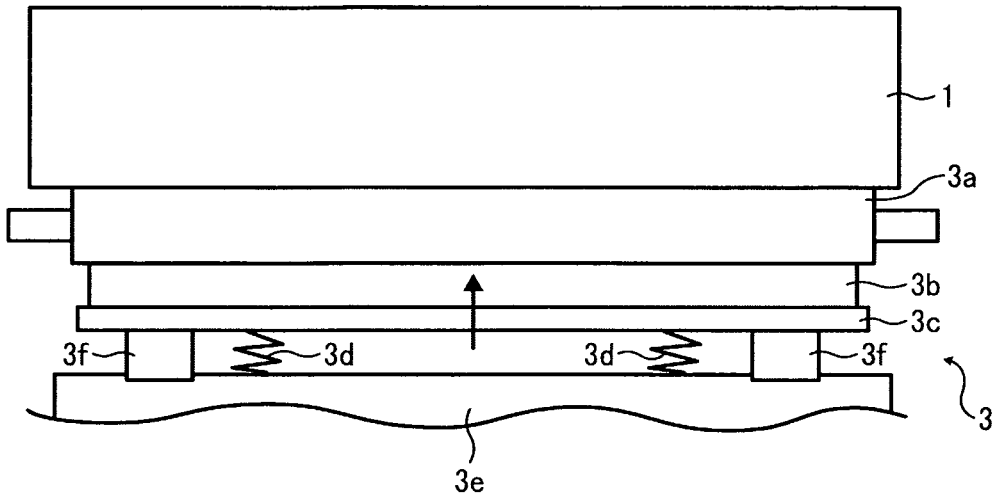
FIGS. 4(*a*) and 4(*b*) are schematic configuration diagrams of Embodiment 1 of the lubricant applicator, which is provided with regulating members.
Figure 4:
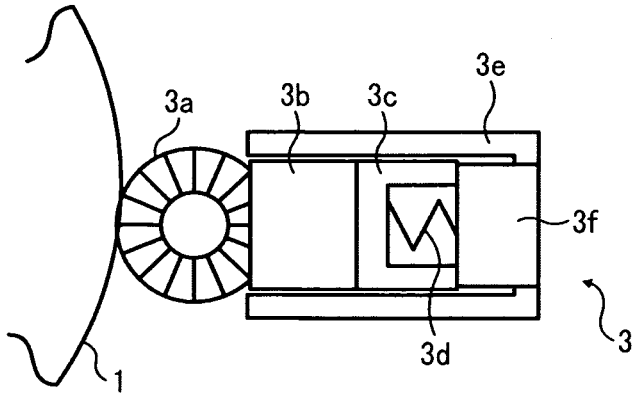
Figure 5:
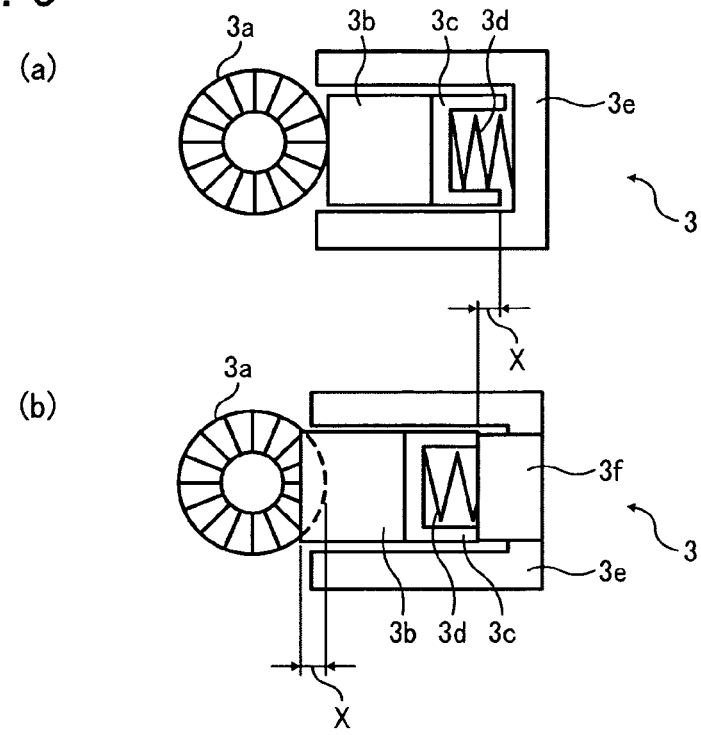
FIGS. 5(*a*) and 5(*b*) are explanatory diagrams illustrating states of contact between a solid lubricant and a brush roller without and with the regulating members of Embodiment 1, respectively.

In view of this, the regulating members 3*f* are provided to prevent the solid lubricant 3*b* from separating from the brush roller 3*a* by more than a predetermined distance due to the force of the brush roller 3*a* pushing back against the solid lubricant 3*b*. FIGS. 4(*a*) and 4(*b*) are schematic configuration diagrams of the lubricant applicator 3 provided with the regulating members 3*f*. FIG. 4(*a*) is a top view of the lubricant applicator 3 taken along the long side thereof. FIG. 4(*b*) is a cross-sectional view of the lubricant applicator 3 taken along the shorter direction thereof. Further, FIGS. 5(*a*) and 5(*b*) are explanatory diagrams illustrating states of contact between the solid lubricant 3*b* and the brush roller 3*a* without and with the regulating members 3*f*, respectively. FIG. 5(*a*) illustrates the contact state in the configuration without the regulating members 3*f*, and FIG. 5(*b*) illustrates the contact state in the configuration with the regulating members 3*f*. As illustrated in FIGS. 4(*a*), 4(*b*), 5(*a*), and 5(*b*), the regulating members 3*f* prevent the solid lubricant 3*b* from separating from the brush roller 3*a* by more than the predetermined distance due to the force of the brush roller 3*a* pushing back against the solid lubricant 3*b*. With this regulation of the position of the solid lubricant 3*b*, the solid lubricant 3*b* constantly penetrates into the brush roller 3*a* by at least a predetermined amount X as shown in FIG. 5(*b*). Thus, at least a predetermined area of contact is maintained between the solid lubricant 3*b* and the brush roller 3*a*, thereby increasing the amount of abrasion of the solid lubricant 3*b* in the initial stage of use to prevent the shortage of the amount of the solid lubricant 3*b* applied to the surface of the photoconductor 1. As described above, the shortage of the amount of the solid lubricant 3*b* applied to the surface of the photoconductor 1 in the initial stage of use is prevented without an increase in the pressure of the solid lubricant 3*b* applied to the brush roller 3*a* by the compressed springs 3*d*.

Meanwhile, overtime the force of the brush roller 3*a* pushing back against the solid lubricant 3*b* is reduced. Thus, the solid lubricant 3*b* is brought into uniform contact with the brush roller 3*a*, increased in the area of contact thereof with the brush roller 3*a*, and prevented from separating from the brush roller 3*a* by more than the predetermined distance. Therefore, the regulation by the regulating members 3*f* terminates, and the lubricant applicator 3 switches to a state in which the solid lubricant 3*b* is brought into contact with and scrapped by the brush roller 3*a* solely with the biasing performed by the compressed springs 3*d*. The compressed springs 3*d* are adjusted to bias the solid lubricant 3*b* toward the brush roller 3*a* with pressure for scraping an appropriate amount of the solid lubricant 3*b* in a stable contact state with an increased contact area. Accordingly, the appropriate amount of the solid lubricant 3*b* is applied during the lapse of time. Further, there is no increase in the pressure of the solid lubricant 3*b* applied to the brush roller 3*a* by the compressed springs 3*d*. Therefore, the lubricant application amount is prevented from being excessively increased due to an increase over time in the amount of penetration of the solid lubricant 3*b* into the brush roller 3*a* and a resultant excessive increase in the area of contact therebetween. Accordingly, the amount of the solid lubricant 3*b* applied to the surface of the photoconductor 1 is maintained to a stable level during the lapse of time.

Figure 6:
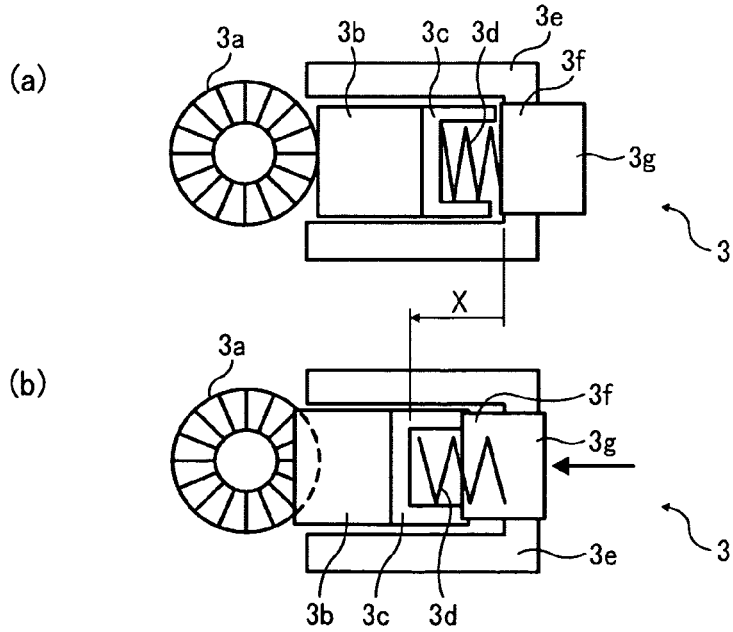
FIGS. 6(*a*) and 6(*b*) are explanatory diagrams illustrating states of contact between the solid lubricant and the brush roller at different positions of the regulating members of Embodiment 1.

Further, the image forming apparatus 100 including the present embodiment of the lubricant applicator 3 allows the regulating members 3*f* to switch between two positions or states, i.e., a position for a regulating state in which the regulating members 3*f* causes forcible application of pressure such that that the solid lubricant 3*b* penetrates into the brush roller 3*a* by at least a predetermined amount, as described above, and the position for a non-regulating state in which the regulating members 3*f* cancel the forcible application of pressure. FIGS. 6(*a*) and 6(*b*) are explanatory diagrams illustrating states of contact between the solid lubricant 3*b* and the brush roller 3*a* at different positions of the regulating members 3*f*. FIG. 6(*a*) illustrates the non-regulating state, and FIG. 6(*b*) illustrates the regulating state. In FIG. 6(*b*), the regulating members 3*f* come into contact with and press the solid lubricant 3*b* or the lubricant holding member 3*c* such that the solid lubricant 3*b* does not separate from the brush roller 3*a* by more than a predetermined distance due to the force of the brush roller 3*a* pushing back against the solid lubricant 3*b*. Meanwhile, in FIG. 6(*a*), the regulating members 3*f* are separated from the solid lubricant 3*b* or the lubricant holding member 3*c* so as not to press the solid lubricant 3*b* or the lubricant holding member 3*c* in the balanced state in which the solid lubricant 3*b* is biased toward the brush roller 3*a* by the compressed springs 3*d*. Further, it is possible to switch the regulating members 3*f* to the non-regulating state not by separating the regulating members 3*f* from the solid lubricant 3*b* or the lubricant holding member 3*c* but by reducing the pressing force of the regulating members 3*f* to be less than the pressing force thereof in the regulating state of FIG. 6(*b*).

With this configuration allowing the regulating members 3*f* to switch between the non-regulating state of FIG. 6(*a*) and the regulating state of FIG. 6(*b*), it is possible to protect the brush roller 3*a* from the pressure of the solid lubricant 3*b* forcibly applied by the regulating members 3*f*. Specifically, the regulating members 3*f* are placed in the non-regulating state of FIG. 6(*a*), when a new lubricant applicator 3 is stored for a long time, or when the lubricant applicator 3 is left standing for a long time in the initial stage of use thereof, for example. It is thereby possible minimize the flattening of the bristles of the brush roller 3*a* when the lubricant applicator 3 is left standing for a long time, and therefore to minimize the generation of an abnormal image attributed to the flattening of the bristles. Further, the regulating members 3*f* are placed in the regulating state of FIG. 6(*b*), when the lubricant applicator 3 is installed and operated in the image forming apparatus 100.

Further, the lubricant applicator 3 allows the switching of the regulating members 3*f* between the non-regulating state and the regulating state to be externally performed. Specifically, a projecting switching member 3*g* that serves as a projecting switch is provided to the lubricant applicator 3. The switching member 3*g* moves in the pressure application direction of the regulating members 3*f* indicated by an arrow in FIG. 6(*b*). With the switching member 3*g* pressed inside the lubricant applicator 3, the regulating members 3*f* are switched from the non-regulating state to the regulating state. The switching member 3*g* may be formed integrally with the regulating members 3*f*, or may be formed separately from the regulating members 3*f*, of course. With this configuration, in the replacement of the lubricant applicator 3, for example, a person who performs the replacement, such as a service technician, can easily switch the state of the regulating members 3*f*.

Figure 7:
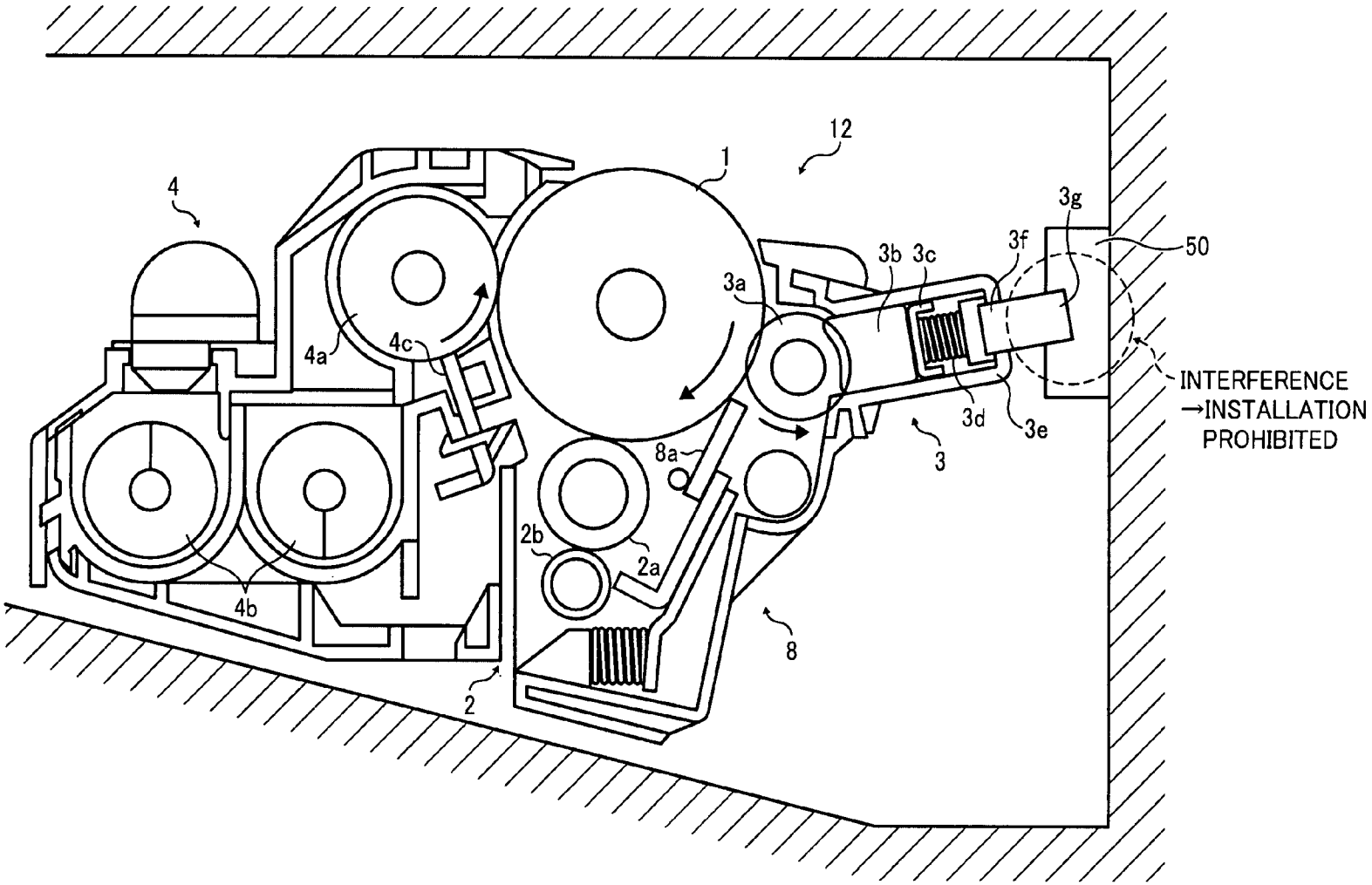
FIG. 7 is a schematic configuration diagram illustrating a configuration in which the installation of Embodiment 1 of the lubricant applicator into the image forming apparatus is disallowed in a non-regulating state.

Further, the lubricant applicator 3 is formed such that the installation thereof in the image forming apparatus 100 is disallowed in the non-regulating state. FIG. 7 is a schematic configuration diagram illustrating an example of the configuration in which the installation of the lubricant applicator 3 into the image forming apparatus 100 is disallowed in the non-regulating state. Further, FIG. 8 is a schematic configuration diagram illustrating an example of the configuration in which the installation of the lubricant applicator 3 in the image forming apparatus 100 is allowed in the regulating state.

Specifically, as illustrated in FIG. 7, the switching member 3*g*, which switches the state of the regulating members 3*f* of the lubricant applicator 3, projects more therefrom in the non-regulating state than in the non-regulating state. In the non-regulating state, the switching member 3*g* of the lubricant applicator 3 interferes with a stopper 50 provided to the image forming apparatus 100, when the lubricant applicator 3 is installed into the image forming apparatus 100. As a result, the lubricant applicator 3 is prevented from being installed into the image forming apparatus 100.

Figure 8:
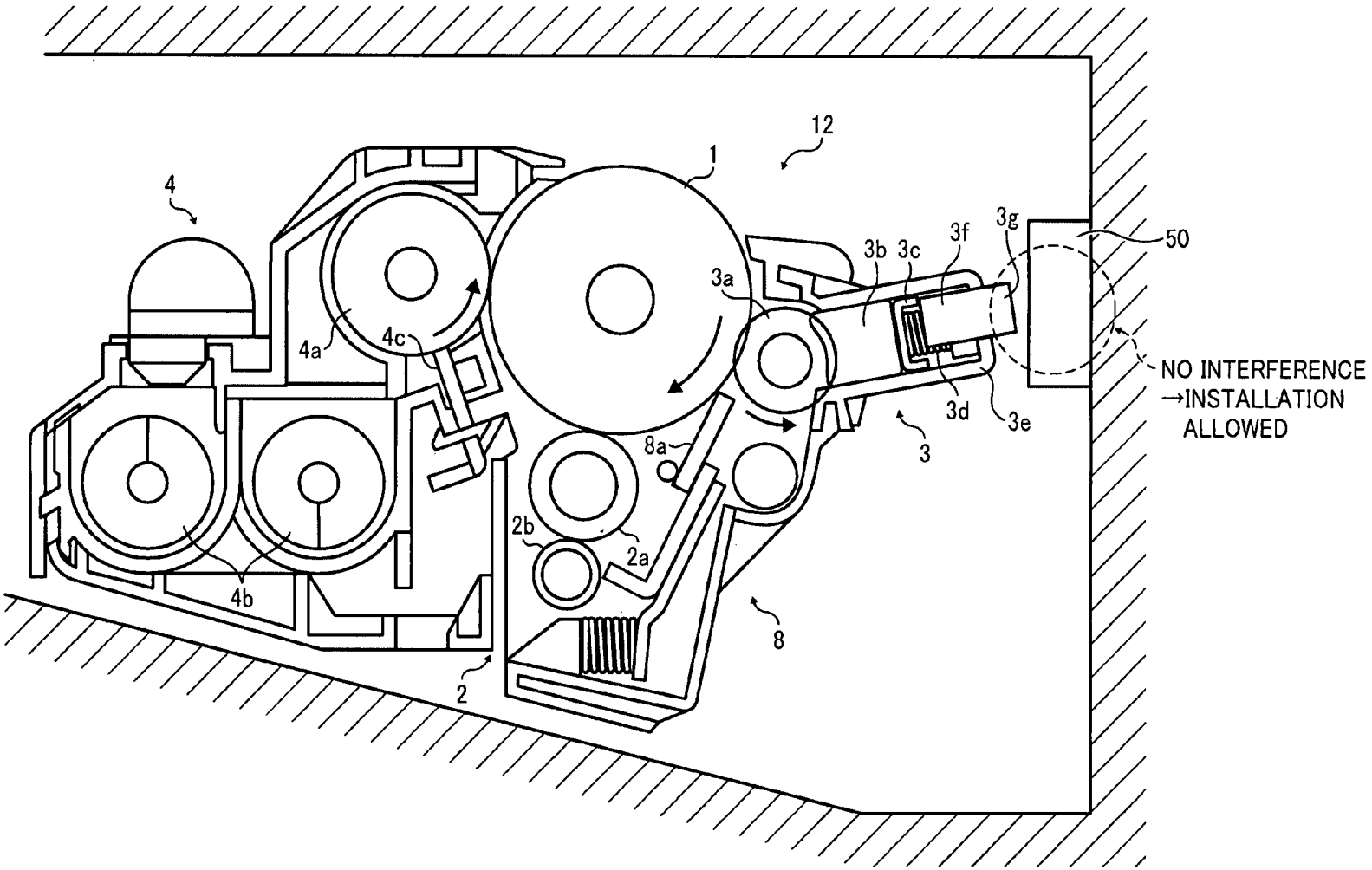
FIG. 8 is a schematic configuration diagram illustrating a configuration in which the installation of Embodiment 1 of the lubricant applicator into the image forming apparatus is allowed in a regulating state.

Meanwhile, as illustrated in FIG. 8, if the switching member 3*g* for switching the state of the regulating members 3*f* of the lubricant applicator 3 is pressed inside the lubricant applicator 3, the regulating members 3*f* are switched from the non-regulating state to the regulating state. Thereby, the lubricant applicator 3 is allowed to be installed into the image forming apparatus 100, with the switching member 3*g* of the lubricant applicator 3 not interfering with the stopper 50. With this configuration, the lubricant applicator 3 is prevented from being installed into the image forming apparatus 100 without switching of the state of the regulating members 3*f*. Accordingly, the effect of the regulating members 3*f* in the initial stage of use of the lubricant applicator 3 is reliably established.

Further, the lubricant applicator 3 may be formed such that, when the lubricant applicator 3 is installed into the image forming apparatus 100, the switching member 3*g* for switching the state of the regulating members 3*f* comes into contact with the stopper 50 provided to the image forming apparatus 100, and thereby switching the regulating members 3*f* from the non-regulating state to the regulating state. This configuration is more effective in preventing the installation of the lubricant applicator 3 without switching of the state of the regulating members 3*f*, and in saving the need to perform the switching operation.

Embodiment 2

Subsequently, Embodiment 2 of the lubricant applicator 3 included in the image forming apparatus 100 according to the present embodiment will be described. Embodiment 2 is different from Embodiment 1 in the following aspects. That is, the present embodiment is different from Embodiment 2 in that, in the present embodiment of the lubricant applicator 3, a lubricant case 3*f'* functioning as a case storing the solid lubricant 3*b*, the lubricant holding member 3*c*, and the compressed springs 3*d* also functions as the regulating members 3*f* and the switching member 3*g* of Embodiment 1 of the lubricant applicator 3. The present embodiment is also different from Embodiment 1 in that the lubricant case 3*f'* is removably installable in the housing 3*e* of the lubricant applicator 3. The present embodiment is further different from Embodiment 1 in that the housing 3*e* of the lubricant applicator 3 is provided with a case holding member 3*e'* which forms a cylindrical opening for receiving the lubricant case 3*f'*, and which holds the lubricant case 3*f'* to be removably installable therein. Therefore, the same components as the components of Embodiment 1 will be designated by the same reference numerals, and description of the same configurations and advantageous effects thereof will be omitted where appropriate.

Figure 9:
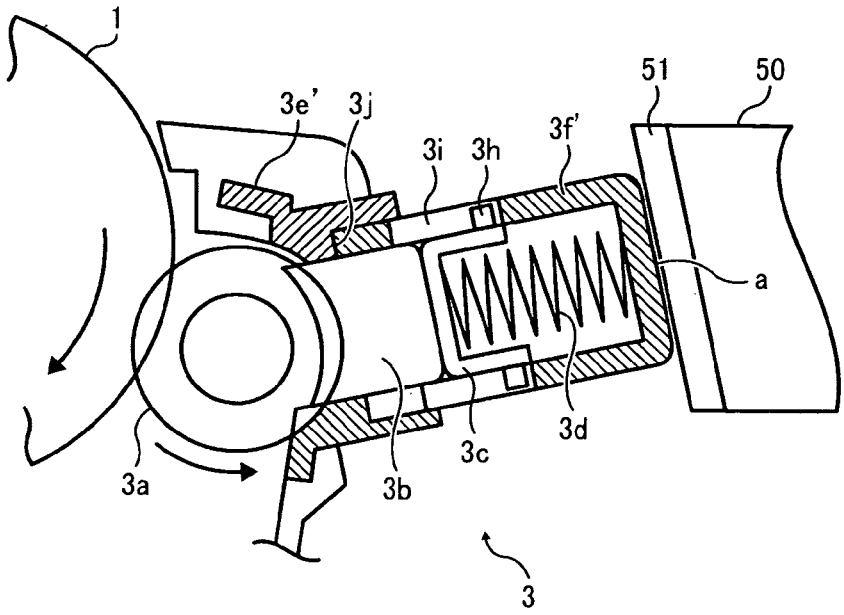
FIG. 9 is a cross-sectional view of a lubricant case of Embodiment 2 of the lubricant applicator.
Figure 10:
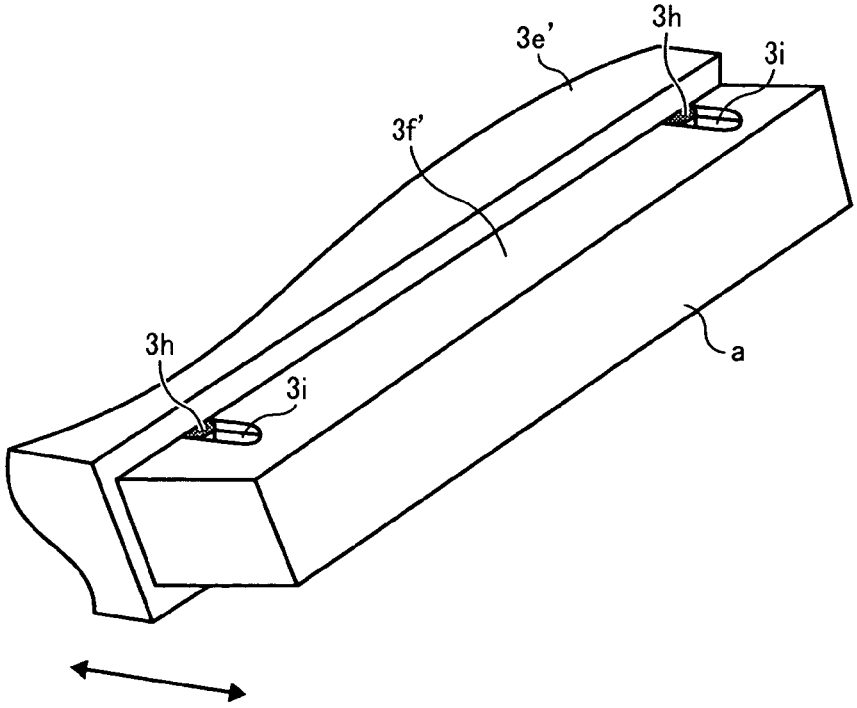
FIG. 10 is a perspective view of the lubricant case of Embodiment 2 of the lubricant applicator.
Figure 11:
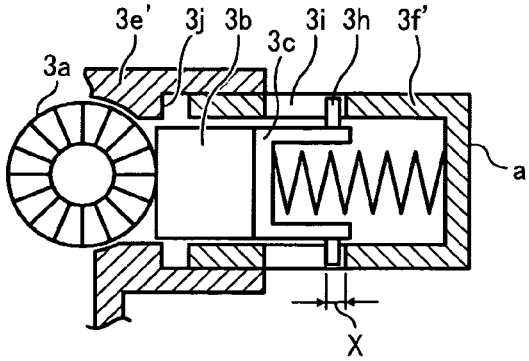
FIGS. 11(*a*), 11(*b*), 11(*c*), and 11(*d*) are explanatory diagrams illustrating states of contact between the solid lubricant and the brush roller, positions of the lubricant case, and states of stored components in Embodiment 2 of the lubricant applicator and a second specific example of Embodiment 3 of the lubricant applicator.
Figure 11:
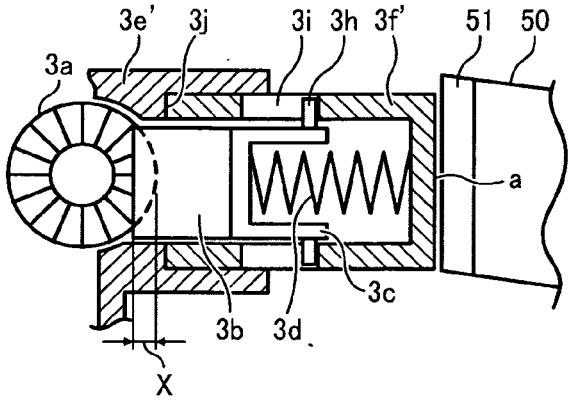
Figure 11:
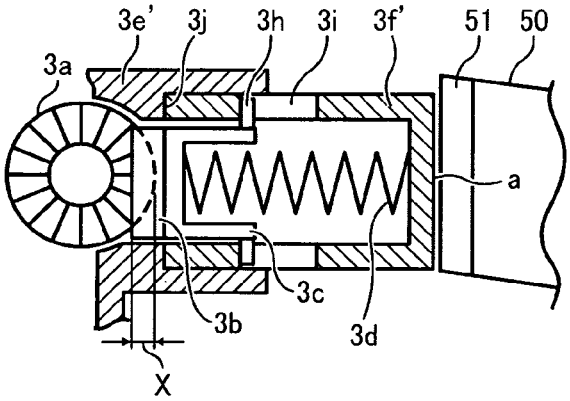
Figure 11:
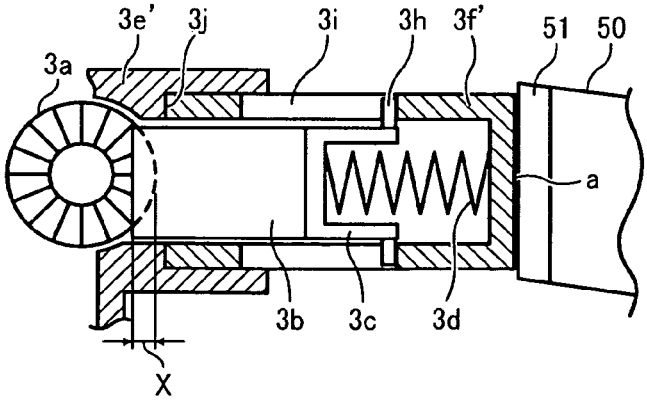

FIG. 9 is a cross-sectional view illustrating the lubricant case 3*f'* of the lubricant applicator 3. Further, FIG. 10 is a perspective view illustrating the lubricant case 3*f'*, as viewed externally from obliquely above. FIGS. 11(*a*), 11(*b*), and 11(*c*) are explanatory diagrams illustrating states of contact between the solid lubricant 3*b* and the brush roller 3*a*, positions of the lubricant case 3*f'*, and respective states of the stored components before and after the installation of the lubricant applicator 3 into the image forming apparatus 100.

As illustrated in FIG. 9, the solid lubricant 3*b* is integrally supported by the lubricant holding member 3*c*. Further, similarly as in Embodiment 1 of the lubricant applicator 3, the solid lubricant 3*b* is biased toward the brush roller 3*a* by the multiple compressed springs 3*d* provided along the longer direction of the lubricant holding member 3*c* and functioning as the biasing member. The surface of the solid lubricant 3*b* is in contact with the brush roller 3*a*. Further, the solid lubricant 3*b*, the lubricant holding member 3*c*, and the compressed springs 3*d* are stored in the lubricant case 3*f'* slidable relative to the case holding member 3*e'*.

As illustrated in FIGS. 9 and 10, the lubricant case 3*f'* is held to be slidable in a direction as indicated by bidirectional arrow in FIG. 10 and removably installable in the case holding member 3*e'*, with the outer circumferential surface of the lubricant case 3*f'* slidingly moving along the inner circumferential surface of the case holding member 3*e'* provided to the housing 3*e* of the lubricant applicator 3. Herein, a portion of the inner circumferential surface of the case holding member 3*e'* from one end of the case holding member 3*e'* on the side of the brush roller 3*a* to a position for receiving the lubricant case 3*f'* to be slidable is formed into a size slightly larger than the size of the solid lubricant 3*b* in the thickness direction such that the solid lubricant 3*b* can slide and come into contact with the brush roller 3*a*. Further, a portion of the inner circumferential surface of the case holding member 3*e'* from the other end of the case holding member 3*e'* to the position for receiving the lubricant case 3*f'* is formed into a size slightly larger than the size of the lubricant case 3*f'* in the thickness direction such that the outer circumferential surface of the lubricant case 3*f'* can slidingly move along the inner circumferential surface of the case holding member 3*e'*. As described above, the inner circumferential surface of the case holding member 3*e'* is formed with a step portion 3*j* which prevents the lubricant case 3*f'* from moving toward the brush roller 3*a* by more than a specified distance. Further, in the present embodiment of the lubricant applicator 3, the state in which the lubricant applicator 3 is allowed to be installed and operate in the image forming apparatus 100 corresponds to the state in which one end of the lubricant case 3*f'* on the side of the brush roller is in contact with the above-described step portion 3*j* of the case holding member 3*e'*.

Further, the lubricant case 3*f'* is a box-shaped member having an opening facing the brush roller 3*a* to store the solid lubricant 3*b*, the lubricant holding member 3*c*, and the compressed springs 3*d*. The size of the opening in a direction perpendicular to the biasing direction of the compressed springs 3*d* toward the brush roller 3*a* is set to be slightly larger than the corresponding size of the solid lubricant 3*b* and the lubricant holding member 3*c* stored in the opening. Thereby, the solid lubricant 3*b* and the lubricant holding member 3*c* are slidably held by the lubricant case 3*f'*.

Further, the lubricant holding member 3*c* holding the solid lubricant 3*b* is a substantially U-shaped member extending parallel to the rotary shaft of the brush roller 3*a*. A surface of the solid lubricant 3*b* opposite to the other surface thereof in contact with the brush roller 3*a* is joined to a lower portion of the substantial U-shape of the lubricant holding member 3*c*, and an opening formed by the substantial U-shape faces the compressed springs 3*d*. The lubricant holding member 3*c* includes two surfaces parallel to the biasing direction of the compressed springs 3*d* toward the brush roller 3*a* and parallel to the rotary shaft of the brush roller 3*a*. At two positions on each of the two surfaces, i.e., at four positions in total on the two surfaces near one end of the lubricant holding member 3*c* on the far side from the solid lubricant 3*b*, projecting portions 3*h* are provided to project toward the outer circumferential surface of the lubricant case 3*f*', and engage with elongated holes 3*i* of the lubricant case 3*f*'.

As described above, the lubricant case 3*f*' is provided with the elongated holes 3*i* of a predetermined length corresponding to the respective projecting portions 3*h* provided to the lubricant holding member 3*c*. The size of each of the elongated holes 3*i* in the shorter direction thereof perpendicular to the biasing direction of the compressed springs 3*d* toward the brush roller 3*a* is set to a size allowing the corresponding projecting portion 3*h* to slidingly move therein. Herein, if a material such as a resin is used to form the lubricant case 3*f*', it is desired to slidably attach the projecting portions 3*h* by using step screws, for example.

Further, the size of each of the elongated holes 3*i* in a direction parallel to the biasing direction toward the brush roller 3*a* is set as follows. As illustrated in FIG. 11(*b*), the position of one end of the elongated hole 3*i* of the lubricant case 3*f*' on the far side from the brush roller 3*a* corresponds to the position for regulating, in the regulating state of the lubricant case 3*f*' functioning as the regulating member, the corresponding projecting portion 3*h* at a position for having the solid lubricant 3*b* penetrate into the brush roller 3*a* by at least a predetermined amount X, even if the solid lubricant 3*b* is new and unused. With this configuration, even if the solid lubricant 3*b* is in the initial stage of use, the one end of the elongated hole 3*i* of the lubricant case 3*f*' on the far side from the brush roller 3*a* comes into contact with the corresponding projecting portion 3*h* of the lubricant holding member 3*c* such that the solid lubricant 3*b* does not separate from the brush roller 3*a* by more than a predetermined distance. Thereby, the position of the solid lubricant 3*b* is regulated. Further, the amount of abrasion of the solid lubricant 3*b* is increased with at least a predetermined area of contact maintained between the solid lubricant 3*b* and the brush roller 3*a*. Even if the solid lubricant 3*b* is in the initial stage of use, therefore, the position of the solid lubricant 3*b* with respect to the brush roller 3*a* is regulated, and the shortage of the amount of the solid lubricant 3*b* applied to the surface of the photoconductor 1 is prevented.

Further, as illustrated in FIG. 11(*c*), the position of the other end of the elongated hole 3*i* of the lubricant case 3*f*' on the side of the brush roller 3*a* corresponds to the position for regulating the corresponding projecting portion 3*h* at a position slightly shifted to the right in the drawing from the position of the lubricant holding member 3*c* at which the solid lubricant 3*b* has been scrapped by the brush roller 3*a* and the area of contact between the solid lubricant 3*b* and the brush roller 3*a* is less than the predetermined area. With this configuration, in addition to the advantageous effect of Embodiment 1 of the lubricant applicator 3, another advantageous effect is obtained. That is, even if the solid lubricant 3*b* is in the final stage of use, at least a predetermined amount of abrasion of the solid lubricant 3*b* is maintained, and the shortage of the amount of the solid lubricant 3*b* applied to the surface of the photoconductor 1 is prevented.

Further, as illustrated in FIG. 11(*a*), in the non-regulating state of the lubricant case 3*f*' functioning as the regulating member, the lubricant case 3*f*' storing the solid lubricant 3*b* is pushed back away from the brush roller 3*a* due to the resilience of the fiber of the brush roller 3*a* and the biasing force of the compressed springs 3*d*. Then, each of the projecting portions 3*h* of the lubricant holding member 3*c* presses the one end of the corresponding elongated hole 3*i* of the lubricant case 3*f*' on the far side from the brush roller 3*a*. Thereby, the one end of the lubricant case 3*f*' on the side of the brush roller 3*a* separates from the step portion 3*j* of the case holding member 3*e*'. In this state, the solid lubricant 3*b* does not apply specified biasing force to the brush roller 3*a*, irrespective of how much the solid lubricant 3*b* has been used. The biasing force of the solid lubricant 3*b* applied to the brush roller 3*a* is thus reduced when the lubricant applicator 3 is not installed in the image forming apparatus 100, and the amount of deformation of the bristles of the brush roller 3*a* is reduced. Therefore, the flattening of the bristles is prevented, even if the lubricant applicator 3 is left standing for a long time without being used.

As described above, in the present embodiment of the lubricant applicator 3, the lubricant case 3*f*' is movable relative to the case holding member 3*e*'. It is therefore possible to externally perform the switching between the regulating state in which the solid lubricant 3*b* is not separate from the brush roller 3*a* by more than a predetermined distance and the non-regulating state in which the solid lubricant 3*b* is separate from the brush roller 3*a* by more than the predetermined distance. Further, the present embodiment of the lubricant applicator 3 is removably installable in the image forming apparatus 100, similarly to Embodiment 1 of the lubricant applicator 3.

Further, similarly as in Embodiment 1 of the lubricant applicator 3, the stopper 50 functioning as a pressing member for pressing the lubricant case 3*f*' may be fixed to a position corresponding to the position of a surface a of the lubricant case 3*f*' functioning as the regulating member of the lubricant applicator 3. With this configuration, the lubricant applicator 3 is prevented from being installed into the image forming apparatus 100, unless the lubricant applicator 3 is set to the installation position, i.e., unless the lubricant case 3*f*' is inserted to the position at which the one end of the lubricant case 3*f*' on the side of the brush roller 3*a* comes into contact with the step portion 3*j* of the case holding member 3*e*'.

Further, in the lubricant applicator 3 installed at the installation position, the lubricant case 3*f*' is pressed toward the brush roller 3*a* by the stopper 50 and regulated at a position at which the one end of the lubricant case 3*f*' on the side of the brush roller 3*a* comes into contact with the above-described step portion 3*j* of the case holding member 3*e*'. It is assumed herein that the compressed springs 3*d* are set to obtain specified pressure in this state.

Further, in the direction of installing of the lubricant applicator 3 into the image forming apparatus 100, each of a portion of the lubricant case 3*f*' interfering with the stopper 50 and the corresponding interfering portion of the stopper 50 is formed into a tapered shape. In the installation of the lubricant applicator 3 into the image forming apparatus 100, the tapered surface of the lubricant case 3*f*' and a tapered portion 51 of the stopper 50 slidingly move relative to each other. Thereby, the movable lubricant case 3*f*' is pressed toward the brush roller 3*a*. The position reached by the pressed lubricant case 3*f*' is set to the position at which the one end of the lubricant case 3*f*' on the side of the brush roller 3*a* comes into contact with the step portion 3*j* of the case holding member 3*e*'. As in this case, the switching between the regulating state and the non-regulating state of the lubricant case 3*f*' may be performed in conjunction with the operation of installing the lubricant applicator 3 into the image forming apparatus 100.

That is, the lubricant case 3*f* can also function as the switching member 3*g* of Embodiment 1.

Further, as described above, the lubricant case 3*f* of the present embodiment of the lubricant applicator 3 is removably installable in the lubricant applicator 3. It is therefore possible to change the amount (i.e., thickness) of the solid lubricant 3*b* and the spring pressure of the compressed springs 3*d* solely by changing the solid lubricant 3*b*, the lubricant case 3*f*, and the compressed springs 3*d*, without changing the housing 3*e* of the lubricant applicator 3. Accordingly, it is possible to standardize the housings 3*e* of the lubricant applicators 3 for the respective colors, the process cartridges including the lubricant applicators 3, or the components of different device models, and thus to contribute to a reduction in cost of the image forming apparatus 100. Further, only some of the components may be changed in accordance with the embodiment desired to be changed, or the components and other components may be changed in combination. A component changing method highly effective in reducing cost may be selected as appropriate.

Embodiment 3

Subsequently, Embodiment 3 of the lubricant applicator 3 included in the image forming apparatus 100 according to the present embodiment will be described. In both Embodiments 1 and 2 of the lubricant applicator 3 included in the image forming apparatus 100 according to the present embodiment, the description has been limited to the configuration of the lubricant applicator 3 alone. The present embodiment is different from Embodiments 1 and 2 in that the present embodiment specifies the correlation between the respective configurations of the lubricant applicators 3Y, 3C, 3M, and 3K corresponding to the four colors, which are included in the color image forming apparatus 100 according to the present embodiment.

The present embodiment is similar to Embodiment 2 in terms of the configuration of the lubricant applicator 3 alone. In the lubricant applicators 3Y, 3C, 3M, and 3K of the present embodiment, however, the fixing position for fixing the stopper 50, which is provided to the image forming apparatus 100 to press the lubricant case 3*f* functioning as the regulating member when the lubricant applicator 3 is installed into the image forming apparatus 100, is different between at least one of the lubricant applicators 3 corresponding to one of the four colors and the lubricant applicators 3 corresponding to the other colors. Herein, the difference in configuration of the present embodiment from Embodiment 2 is limited to the above-described configuration in which the fixing position for fixing the stopper 50 is different between at least one of the lubricant applicators 3 corresponding to one of the four colors and the lubricant applicators 3 corresponding to the other colors. Thus, the same components as the components of Embodiment 2 of the lubricant applicator 3 will be designated by the same reference numerals, and description of the same configurations and advantageous effects thereof will be omitted where appropriate.

The following description will be made of specific examples of the lubricant applicators 3, in which the fixing position for fixing the stopper 50 is different between at least one of the lubricant applicators 3 corresponding to one of the four colors and the lubricant applicators 3 corresponding to the other colors. Detailed description will be made of a specific example which reduces the spring pressure of the compressed springs 3*d* of the lubricant applicator 3 corresponding to a specific color, and a specific example which increases the amount (thickness) of the solid lubricant 3*b* of the lubricant applicator 3 corresponding to a specific color, followed by description of issues of the related-art lubricant applicator.

First Example of Embodiment 3

Figure 12:
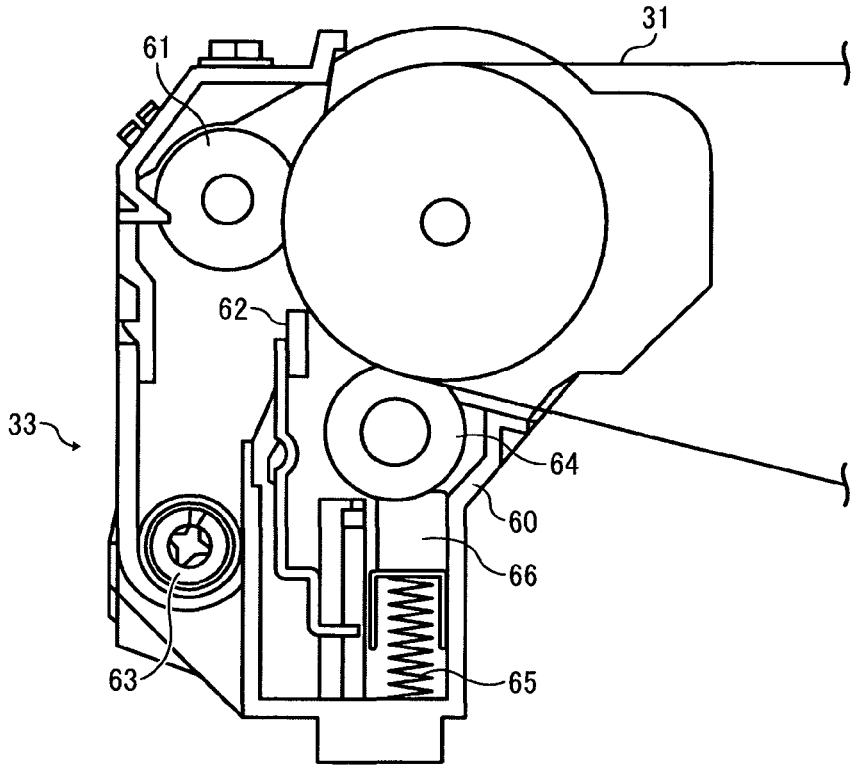
FIG. 12 is a schematic configuration diagram of an intermediate transfer belt cleaning device in a first specific example of Embodiment 3.

Description will be first made of a first specific example of Embodiment 3, i.e., a specific example of the lubricant applicators 3 reducing the spring pressure of the compressed springs 3*d* of the lubricant applicator 3 corresponding to a specific color. FIG. 12 is a schematic configuration diagram of the intermediate transfer belt cleaning device 33 of the image forming apparatus 100 including the present specific example of the lubricant applicator 3. The intermediate transfer belt cleaning device 33 is provided with a housing 60. In the housing 60 of the intermediate transfer belt cleaning device 33, an intermediate transfer belt cleaning roller 61 and a cleaning blade 62 are provided on the upstream side in the rotation direction of the intermediate transfer belt 31 (hereinafter referred to as the upstream side) to clean off paper dust and post-transfer residual toner adhering to the intermediate transfer belt 31. The paper dust and toner removed here are discharged into a not-illustrated waste toner storage unit by a conveying screw 63. Further, on the downstream side in the rotation direction of the intermediate transfer belt 31 (hereinafter referred to as the downstream side), a brush roller 64 functioning as a lubricant applying member for applying lubricant to the intermediate transfer belt 31 is made in constant contact with the intermediate transfer belt 31. Further, a solid lubricant 66 is brought into constant contact with the brush roller 64 by compressed springs 65 with predetermined contact pressure.

Figure 13:
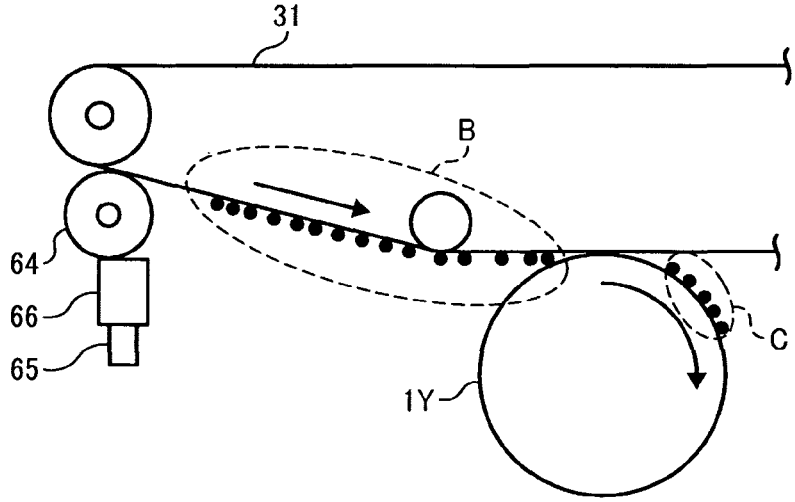
FIG. 13 is an explanatory diagram for explaining a phenomenon in which lubricant applied to an intermediate transfer belt moves to the most upstream photoconductor in the first specific example of Embodiment 3.

In this case, the lubricant applied to the intermediate transfer belt 31 passes the respective photoconductors 1 corresponding to the four colors before reaching a secondary transfer unit formed by the secondary transfer roller 34 and an opposite roller facing the secondary transfer roller 34. Herein, as illustrated in FIG. 13, when the intermediate transfer belt 31 comes into contact with the photoconductors 1, a part of the lubricant applied to the intermediate transfer belt 31 by the brush roller 64 but insufficiently adhering to the intermediate transfer belt 31 (indicated by a broken line B) is reverse-transferred to the photoconductors 1 in powder form (indicated by a broken line C). A relatively large amount of the lubricant applied to the intermediate transfer belt 31 by the brush roller 64 but insufficiently adhering to the intermediate transfer belt 31 is transferred particularly to the photoconductor 1Y located on the most upstream side of the intermediate transfer belt 31.

Figure 14:
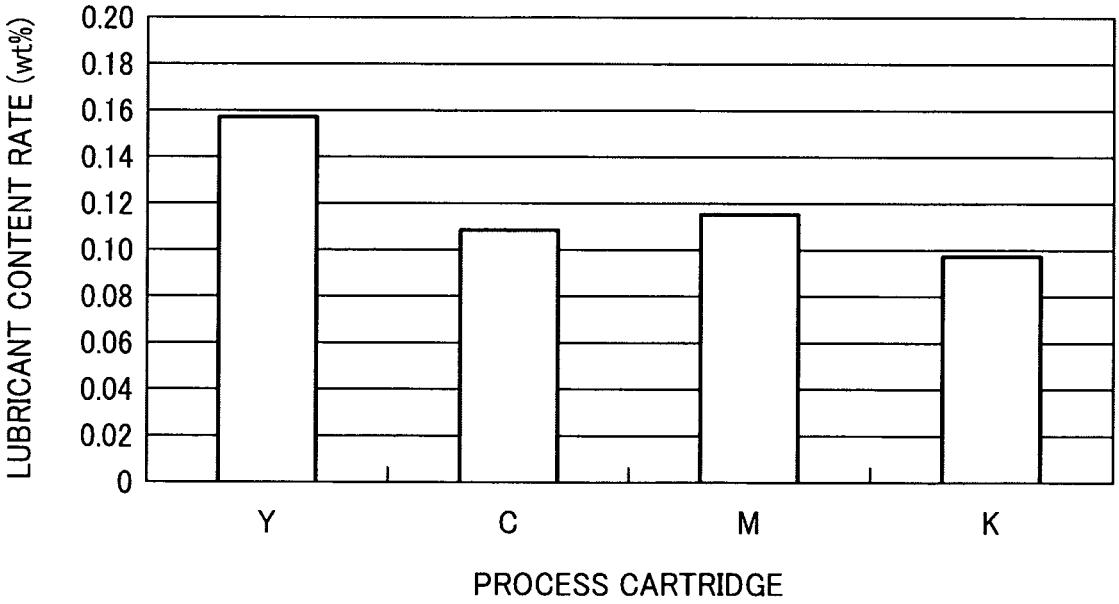
FIG. 14 is a graph illustrating an example of lubricant contents of respective waste toners of photoconductors in the first specific example of Embodiment 3.

FIG. 14 illustrates graphs of an example of the results of analysis of the ratios of the lubricant contained in respective waste toners collected from the cleaning devices 8 corresponding to the photoconductors 1 for the respective colors. The setting value of the spring pressure of the compressed springs 3*d* was set to obtain a lubricant application amount of approximately 0.15 g/km applied to each of the photoconductors 1 for the respective colors. Further, the rotation rate of the brush roller 3*a* per unit time was set to the same value in the lubricant applicators 3. The actually obtained lubricant consumption amounts of the lubricant applicators 3 for the respective colors were substantially equal to the targeted value. As illustrated in FIG. 14, however, the amount of the lubricant contained in the waste toner of the cleaning device 8Y corresponding to the photoconductor 1Y was prominently increased. This indicates the result that, in the lubricant applied to the intermediate transfer belt 31 by the brush roller 64 on the upstream side of the photoconductor 1Y, powdery lubricant insufficiently adhering to the intermediate transfer belt 31 was transferred to the photoconductor 1Y.

The estimated values calculated from the amounts of the lubricant contained in the waste toners reveal that the lubricant applied to the photoconductor 1Y was approximately 1.4 times the lubricant applied to each of the other photoconductors 1C, 1M, and 1K, i.e., that the photoconductor 1Y was applied with an excessive amount of the lubricant.

To maintain the target lubricant application amount in each of the photoconductors 1 for the respective colors, therefore, it is conceivable to previously reduce the lubricant application amount of the most upstream lubricant applicator 3 such that the combination of the thus reduced lubricant application amount and the amount of the lubricant transferred to the photoconductor 1Y from the intermediate transfer belt 31 corresponds to an appropriate lubricant application amount. Background methods of reducing the lubricant application amount in the lubricant applicator for the photoconductor corresponding to a specific color include a method of reducing the rotation rate per unit time of the brush roller corresponding to the specific color, and a method of reducing the setting value of the spring pressure of the compressed springs corresponding to the specific color.

According to the method of reducing the rotation rate per unit time of the brush roller corresponding to the specific color, however, a drive device and a control device are provided for each of the colors to reduce the rotation rate per unit time of the brush roller for each of the colors. Further, according to the method of reducing the setting value of the spring pressure of the compressed springs corresponding to the specific color, a typically used case storing the solid lubricant, the lubricant holding member, and the compressed springs is fixed in many cases. Therefore, the housing of the lubricant applicator for the specific color is made different from the housings of the lubricant applicators for the other colors, or the compressed springs used for the specific color is made different from the compressed springs used for the other colors. Both methods have issues such as an increase in number of components and difficulty in standardizing the components. The above-described configurations of the lubricant applicators, therefore, fail to contribute to a reduction in cost of the image forming apparatus.

Meanwhile, the present specific example of the lubricant applicator 3 is capable of contributing to a reduction in cost of the image forming apparatus 100, while preventing excessive application of the solid lubricant 3*b* to the most upstream photoconductor 1Y. The present specific example of the lubricant applicator 3 will be described below.

To maintain the target lubricant application amount, it is necessary to previously lower the setting value of the spring pressure of the compressed springs 3*d* in the most upstream lubricant applicator 3Y and thereby reduce the lubricant application amount of the lubricant applicator 3Y such that the combination of the thus reduced lubricant application amount and the amount of the lubricant transferred to the photoconductor 1Y from the intermediate transfer belt 31 corresponds to an appropriate lubricant application amount.

Unlike Embodiment 2 of the lubricant applicator 3, in the present specific example of the lubricant applicator 3, the spring pressure applied in the operation of each of the lubricant applicators 3 for the respective colors is not determined solely by the lubricant applicator 3 but is determined by the stopper 50 illustrated in FIG. 9, which is fixed to the image forming apparatus 100 and functions as the pressing member for pressing the lubricant case 3*f* of the lubricant applicator 3 installed in the image forming apparatus 100.

As illustrated in FIG. 14, it is now assumed that, if the lubricant applicators 3 corresponding to the respective colors are set to have the same spring pressure of the compressed springs 3*d* and the same rotation rate per unit time of the brush roller 3*a*, the lubricant application amount of the photoconductor 1Y located on the most upstream side is approximately 1.4 times the lubricant application amount of each of the other photoconductors 1C, 1M, and 1K.' In this case, if the lubricant application amount of the photoconductor 1Y applied by the lubricant applicator 3Y is reduced to the inverse number of 1.4, i.e., approximately 70%, the lubricant application amount of the photoconductor 1Y combined with the amount of the lubricant transferred to the photoconductor 1Y from the intermediate transfer belt 31 is equalized to the lubricant application amount of each of the other photoconductors 1C, 1M, and 1K.

Further, the lubricant application amount of the photoconductor 1Y applied by the lubricant applicator 3Y can be reduced to approximately 70% of the lubricant application amount applied by each of the other lubricant applicators 3C, 3M, and 3K, if the spring pressure of the lubricant applicator 3Y is reduced to approximately 70% of the spring pressure of each of the other lubricant applicators 3C, 3M, and 3K.

In the present specific example of the lubricant applicator 3, therefore, the stopper 50 corresponding to the lubricant applicator 3Y is changed in fixing position for the lubricant case 3*f*', and is fixed at a position for reducing the spring pressure of the compressed springs 3*d* of the lubricant applicator 3Y to approximately 70% of the spring pressure of the compressed springs 3*d* included in each of the other lubricant applicators 3C, 3M, and 3K. Thereby, the lubricant application amount applied by the lubricant applicator 3Y is reduced to approximately 70% of the lubricant application amount applied by each of the other lubricant applicators 3C, 3M, and 3K. Further, as described above in Embodiment 2, the lubricant case 3*f*' is removably installable in the housing 3*e* of the lubricant applicator 3. Therefore, the stopper 50 functioning as the pressing member of the image forming apparatus 100 and corresponding to the lubricant applicator 3Y is changed in position, without a change in configuration of the housing of the lubricant applicator 3Y from the configuration of the housings of the other lubricant applicators 3C, 3M, and 3K. Further, the lubricant case 3*f*' of the lubricant applicator 3Y is replaced by another lubricant case 3*f*' changed in shape in accordance with the amount (i.e., distance) of the change in position. It is therefore possible to obtain spring pressure suitable for pressing the solid lubricant 3*b* suitable for the corresponding color toward the brush roller 3*a*. In this case, if the amount (thickness) of the solid lubricant 3*b* is not changed, the lubricant case 3*f*' is formed such that the distance from the end of each of the elongated holes 3*i* thereof on the far side from the brush roller 3*a* to the surface a thereof in contact with the stopper 50 is increased to the position for obtaining the target value of the spring pressure of the compressed springs 3*d*. Thereby, the lubricant application amount applied by the lubricant applicator 3Y is reduced to approximately 70% of the lubricant application amount applied by each of the other lubricant applicators 3C, 3M, and 3K. Further, the lubricant consumption amount of the lubricant applicator 3Y is also reduced. Therefore, if the volume (i.e., thickness) of the solid lubricant 3*b* is reduced, the length of the elongated holes 3*i* of the lubricant case 3*f*' in the lubricant applicator 3Y is reduced by a value corresponding to the reduction in volume (thickness) of the solid lubricant 3*b*. Thereby, the lubricant application amount applied by the lubricant applicator 3Y is reduced to approximately 70% of the lubricant application amount applied by each of the other lubricant applicators 3C, 3M, and 3K.

As described above, according to the present specific example of the lubricant applicator 3, when reducing the setting value of the spring pressure of the compressed springs 3*d* in the lubricant applicator 3 corresponding to a specific color, it is unnecessary to make the housing 3*e* of the lubricant applicator 3 corresponding to the specific color different from the housings 3*e* of the lubricant applicators 3 corresponding to the other colors, unlike the related-art lubricant applicator. Accordingly, the present specific example does not have issues such as an increase in number of components and difficulty in standardizing the components, and is capable of contributing to a reduction in cost of the image forming apparatus 100.

Second Example of Embodiment 3

Subsequently, description will be made of a second specific example of Embodiment 3, i.e., a specific example of the lubricant applicator 3 increasing the amount (thickness) of the solid lubricant 3*b* of the lubricant applicator 3 corresponding to a specific color. As widely known, in a full-color image forming apparatus 100 using toners of multiple colors, monochrome image forming processing, i.e., image forming processing using a process cartridge containing a black toner (hereinafter referred to as the black cartridge) is performed much more frequently than full-color image forming processing in an actual use environment such as an office. Further, due to the frequent image forming processing using the black cartridge, the solid lubricant 3*b* of the lubricant applicator 3 included in the black cartridge (hereinafter referred to as the lubricant applicator 3K) is consumed more than the solid lubricants 3*b* of the lubricant applicators 3 included in the process cartridges corresponding to the other colors (hereinafter referred to as the color cartridges).

For example, it is now assumed that the maximum number of prints produced by the black cartridge is specified as 1.8 times the maximum number of prints produced by each of the color cartridges corresponding to the other colors. In this case, if the color cartridge and the black cartridge are the same in the amount of the solid lubricant 3*b* consumed for producing the same number of prints, the solid lubricant 3*b* included in the black cartridge needs to be approximately 1.8 times larger in volume than the solid lubricant 3*b* included in the color cartridge. Further, if the volume of the solid lubricant 3*b* in FIG. 11(*b*) corresponds to the life of the color cartridge, the volume of the solid lubricant 3*b* included in the black cartridge needs to be approximately 1.8 times the volume of the solid lubricant 3*b* in FIG. 11(*b*).

However, a typically used case storing the solid lubricant, the lubricant holding member, and the compressed springs is fixed in many cases. Therefore, to increase the volume of the solid lubricant 3*b* by approximately 1.8 times in the lubricant applicator 3K corresponding to the black cartridge, it is necessary to form the housing of the lubricant applicator 3K to be different from the housings 3*e* of the lubricant applicators 3 corresponding to the other colors. Therefore, there are issues such as an increase in number of components of the lubricant applicators 3 and the process cartridges and difficulty in standardizing the components. Thus, this type of configuration of the lubricant applicator fails to contribute to a reduction in cost of the image forming apparatus.

In view of the above, in the present specific example of the lubricant applicator 3, the volume of the solid lubricant 3*b* in the lubricant applicator 3K is increased by approximately 1.8 times the volume of the solid lubricant 3*b* included in each of the color cartridges, as illustrated in FIG. 11(*d*). In this case, the constituent components of the black cartridge other than the solid lubricant 3*b* and the lubricant case 3*f'* are the same as the constituent components of the color cartridges. As for the lubricant case 3*f'*, the length of the elongated holes 3*i* of the lubricant case 3*f'* corresponding to the black color is increased by a value corresponding to the increase in volume (thickness) of the solid lubricant 3*b*, as compared with the length of the elongated holes 3*i* of the lubricant cases 3*f'* corresponding to the other colors. With this configuration, the length of the entirety of the lubricant cases 3*f'* corresponding to the black color is also increased by a value corresponding to the increase in volume (thickness) of the solid lubricant 3*b*.

In this case, the spring pressure and the position of the stopper 50 functioning as the pressing member of the image forming apparatus 100 are set such that the lubricant case 3*f'* corresponding to the black color can obtain appropriate spring pressure at a position slidingly moved by a distance corresponding to the increase in volume of the solid lubricant 3*b* as compared with the volume of the solid lubricants 3*b* in the color cartridges. Specifically, the fixing position of the stopper 50 is moved away from the brush roller 3*a* by a distance corresponding to the increase in length of the entirety of the lubricant case 3*f'*. Accordingly, it is possible to increase the amount of the solid lubricant 3*b* used in the black cartridge, while using the same components in most of the components forming the lubricant applicators 3 and in most of the components forming the black cartridge and the color cartridges including the lubricant applicators 3. Further, it is possible to increase the life of the process cartridge using the lubricant applicator 3K corresponding to the black color.

Further, in the present specific example of the lubricant applicator 3, it is unnecessary to make the housing of the lubricant applicator 3K corresponding to the black color different from the housings 3*e* of the lubricant applicators 3 corresponding to the other colors, unlike the related-art lubricant applicator. Therefore, the present specific example does not have problems such as an increase in number of components and difficulty in standardizing the components, and is capable of contributing to a reduction in cost of the image forming apparatus 100.

As described above, in the image forming apparatus 100 according to the present embodiment, the description has been made of the example in which a new lubricant applicator 3 is placed in the non-regulating state during the long time storage thereof and switched to the regulating state when installed into the image forming apparatus 100. However, the present invention is not limited thereto, and is also applicable to the prevention of the flattening of the bristles of the brush rollers 3*a* occurring when the new lubricant applicator 3 installed in the image forming apparatus 100 is used for a short time and then left standing for a long time without being activated, or when the lubricant applicator 3 is detached from the image forming apparatus 100 and left standing. In this case, the lubricant applicator 3 is formed such that the regulating members 3*f* or the lubricant case 3*f'* functioning as the regulating member can be switched to the non-regulating state, when the new lubricant applicator 3 installed in the image forming apparatus 100 is used for a short time and then left standing for a long time in the initial stage of use. Thereby, the brush roller 3*a* is prevented from being pressed by the solid lubricant 3*b* forcibly applied with pressure by the regulating members 3*f* or the lubricant case 3*f'* functioning as the regulating member. Accordingly, it is possible to minimize the flattening of the bristles of the brush roller 3*a* when the lubricant applicator 3 is left standing for a long time in the initial stage of use, and to minimize the generation of an abnormal image attributed to the flattening of the bristles.

Further, in the image forming apparatus 100 according to the above-described embodiment, the description has been made of the photoconductors 1 functioning as the image carrying members. However, the present invention is not limited thereto. For example, the above-described lubricant applicator 3 may be included in the transfer unit 30 including the intermediate transfer belt 31, to which the toner images are transferred from the photoconductors 1Y, 1C, 1M, and 1K. This configuration provides the intermediate transfer belt 31 with effects similar to the above-described effects.

Further, in the image forming apparatus 100 according to the above-described embodiment, which uses the brush roller 3*a* as the lubricant applying member, the description has been made of the present invention as a device for preventing the flattening of the bristles of the brush roller 3*a*, i.e., deformation of the lubricant applying member. However, the prevent invention is not limited thereto. The prevent invention is also applicable to an example using a sponge roller as the lubricant applying member, and effects similar to the above-described effects can be obtained.

As described above, according to Embodiment 1, the regulating members 3*f* are included in the lubricant applicator 3 which uses the compressed springs 3*d* functioning as the biasing member to bias the solid lubricant 3*b* toward the brush roller 3*a* functioning as the lubricant applying member for applying lubricant to the surface of the photoconductor 1. When the solid lubricant 3*b* is biased toward the brush roller 3*a* by the compressed springs 3*d*, the regulating members 3*f* regulate the solid lubricant 3*b* not to separate from the brush roller 3*a* by more than a predetermined distance. The regulating members 3*f* are switchable between the regulating state and the non-regulating state in which the regulating state is cancelled. When the regulating members 3*f* are in the regulating state, pressure is forcibly applied to maintain at least a predetermined area of contact between the solid lubricant 3*b* and the brush roller 3*a*. Thereby, the amount of abrasion of the solid lubricant 3*b* is increased, and the shortage of the amount of the solid lubricant 3*b* applied to the surface of the photoconductor 1 is prevented. Further, when the regulating members 3*f* are switched from the regulating state to the non-regulating state, the brush roller 3*a* is prevented from being pressed by the solid lubricant 3*b* forcibly applied with pressure by the regulating members 3*f*. Thereby, the solid lubricant 3*b* is prevented from being constantly pressed against the brush roller 3*a* by the regulating members 3*f*. Accordingly, it is possible to minimize the deformation of the brush roller 3*a* when the lubricant applicator 3 is left standing for a long time, and to minimize the generation of an abnormal image attributed to the deformation.

Further, according to Embodiment 1, the regulating members 3*f* may switch to the regulating state by pressing the solid lubricant 3*b* or the lubricant holding member 3*c*, and may easily switch to the non-regulating state in accordance with a reduction in pressing force thereof to be less than the pressing force in the regulating state.

Further, according to Embodiment 1, the regulating members 3*f* may switch to the regulating state by pressing the solid lubricant 3*b* or the lubricant holding member 3*c*, and may easily switch to the non-regulating state by separating from the solid lubricant 3*b* or the lubricant holding member 3*c*.

Further, according to Embodiment 1, if the switching between the regulating state and the non-regulating state of the regulating members 3*f* is allowed to be performed outside the lubricant applicator 3, it is possible to easily switch the state of the regulating members 3*f* in, for example, the replacement of the lubricant applicator 3.

Further, according to Embodiment 1, the lubricant applicator 3 is removably installable in the image forming apparatus 100, and the regulating members 3*f* are placed in the regulating state when the lubricant applicator 3 is installed in the image forming apparatus 100. Accordingly, the effect of the regulating members 3*f* in the initial stage of use of the lubricant applicator 3 is reliably exerted.

Further, according to Embodiment 1, when the regulating members 3*f* of the lubricant applicator 3 are in the non-regulating state, the installation of the lubricant applicator 3 into the image forming apparatus 100 is disallowed. Thereby, the lubricant applicator 3 is prevented from being installed into the image forming apparatus 100 without switching of the state of the regulating members 3*f*, and the effect of the regulating members 3*f* in the initial stage of use of the lubricant applicator 3 is reliably exerted.

Further, according to Embodiment 1, the regulating members 3*f* may switch from the non-regulating state to the regulating state in accordance with the operation of installing the lubricant applicator 3 into the image forming apparatus 100. With this configuration, the lubricant applicator 3 is prevented from being installed into the image forming apparatus 100 without switching of the state of the regulating members 3*f*. Further, it is unnecessary to perform the switching operation, and the installation operation is made simple.

Further, according to Embodiment 1, the solid lubricant 3*b* preferably includes zinc stearate. Therefore, favorable effects, such as an increase in life of the image carrying member and improvement of the transfer performance against, for example, the wormhole phenomenon occurring in the transfer process, are obtained.

Further, according to Embodiment 2, the regulating members 3*f* of Embodiment 1 are replaced by the lubricant case 3*f'* removably installable in the housing 3*e* of the lubricant applicator 3 for storing the solid lubricant 3*b* and the compressed springs 3*d*. With this configuration, it is possible to change the amount (thickness) of the solid lubricant 3*b* and the spring pressure of the compressed springs 3*d* solely by changing the solid lubricant 3*b*, the lubricant case 3*f'*, and the compressed springs 3*d*, without changing the housing 3*e* of the lubricant applicator 3. It is therefore possible to standardize the housings 3*e* of the lubricant applicators 3 or the components of the process cartridges. Accordingly, this configuration is capable of contributing to a reduction in cost of the image forming apparatus 100.

Further, according to Embodiments 1 and 2, the photoconductor 1 is formed integrally with at least one of the charging device 2, the cleaning device 8, and the development device 4, and the above-described lubricant applicator 3 is adopted in the process cartridge, i.e., the image forming unit 12 removably installable in the image forming apparatus 100. Accordingly, it is possible to improve the cleaning performance of the photoconductor 1, increase the life thereof, and improve the transfer performance thereof against, for example, the wormhole phenomenon occurring in the image transfer process, and to improve the maintenance performance.

Further, according to Embodiments 1 and 2, the above-described lubricant applicator 3 is adopted in the transfer unit 30 including the intermediate transfer belt 31. Accordingly, it is possible to improve the cleaning performance of the intermediate transfer belt 31, increase the life thereof, and improve the transfer performance thereof against, for example, the wormhole phenomenon occurring in the image transfer process.

Further, according to Embodiments 1 and 2, the image forming apparatus 100 includes the above-described process cartridge or the above-described transfer unit 30. Accordingly, it is possible to improve the cleaning performance of the photoconductor 1 or the intermediate transfer belt 31, increase the life thereof, and improve the transfer performance thereof against, for example, the wormhole phenomenon occurring in the image transfer process.

Further, according to Embodiments 1 and 2, the image forming apparatus 100 includes the above-described lubricant applicator 3. Accordingly, a high-quality image is stably obtained.

Further, according to Embodiment 3, the lubricant applicators 3 similar to Embodiment 2 is provided as the lubricant applicators 3Y, 3C, 3M, and 3K corresponding to four colors. Further, the fixing position of the stopper 50, which functions as the pressing member of the image forming apparatus 100 for pressing the lubricant case 3*f*' functioning as the regulating member when the lubricant applicator 3 is installed into the image forming apparatus 100, is made different between at least one of the lubricant applicators 3 corresponding to one of the four colors and the lubricant applicators 3 corresponding to the other colors. Accordingly, it is possible to change the amount of the solid lubricant 3*b* and the spring pressure of the compressed springs 3*d* of the lubricant applicator 3 corresponding to a specific color, without changing the housing 3*e* of the lubricant applicator 3, and thus to obtain a suitable lubricant application amount and a suitable solid lubricant amount for the specific color. Further, the above-described changes are attained with minimum necessary changes in the components of the solid lubricant 3*b*, the lubricant case 3*f*', and the compressed springs 3*d* and the change in fixing position of the stopper 50 of the image forming apparatus 100. Accordingly, the configuration allows the standardization of the housings 3*e* of the lubricant applicators 3 or the components of the process cartridges, and thus is capable of contributing to a reduction in cost of the image forming apparatus 100.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

The invention claimed is:

1. A lubricant applicator, comprising:

a solid lubricant;

a lubricant applying member to apply the solid lubricant to a target object;

a biasing member to bias the solid lubricant toward the lubricant applying member;

a regulating member to regulate the solid lubricant, which is biased toward the lubricant applying member by the biasing member, to prevent the lubricant from separating from the lubricant applying member by more than a predetermined distance, the regulating member being switchable between a regulating state for regulating the solid lubricant not to separate from the lubricant applying member by more than the predetermined distance and a non-regulating state;

a projecting switch projecting from the lubricant applicator; and a stopper, wherein the regulating member is switched externally between the regulating state and the non-regulating state.

2. The lubricant applicator according to claim 1, further comprising a lubricant holding member to hold the solid lubricant, wherein the regulating member switches to the regulating state by pressing the solid lubricant or the lubricant holding member, and the regulating member switches to the non-regulating state in accordance with a reduction in pressing force of the regulating member below the pressing force exerted in the regulating state.

3. The lubricant applicator according to claim 1, further comprising a lubricant holding member to hold the solid lubricant, wherein the regulating member switches to the regulating state by coming into contact with the solid lubricant or the lubricant holding member, and the regulating member switches to the non-regulating state by separating from the solid lubricant or the lubricant holding member.

4. The lubricant applicator according to claim 1, removably installed in an image forming apparatus with the regulating member in the regulating state.

5. The lubricant applicator according to claim 4, wherein, in the non-regulating state of the regulating member of the lubricant applicator, the installation of the lubricant applicator into the image forming apparatus is prohibited.

6. The lubricant applicator according to claim 4, wherein the regulating member switches from the non-regulating state to the regulating state upon installation of the lubricant applicator in the image forming apparatus.

7. The lubricant applicator according to claim 1, wherein the solid lubricant includes zinc stearate.

8. The lubricant applicator according to claim 1, further comprising a housing, wherein the regulating member forms a lubricant case which stores the solid lubricant and the biasing member, and which is removably installable in the housing of the lubricant applicator.

9. An image forming apparatus, comprising:

multiple image carrying members corresponding to carry electrostatic latent images formed on respective surfaces thereof;

a latent image forming device corresponding to the multiple color image carrying members, to form electrostatic latent images on the respective surfaces of the multiple image carrying members;

multiple development devices corresponding to the multiple color image carrying members, to develop the electrostatic latent images into toner images of multiple colors;

a transfer device to transfer the toner images of the multiple colors onto a recording medium; and multiple lubricant applicators according to claim 8, corresponding to the multiple color image carrying members, to apply the lubricant to respective surfaces of the image carrying members, wherein, upon installation of the lubricant applicators in the image forming apparatus, a fixing position of the regulating member of at least one of the lubricant applicators is different between that of the other lubricant applicators.

10. The lubricant applicator according to claim 1, wherein the lubricant applying member is a brush.

11. The lubricant applicator according to claim 1, wherein the lubricant applying member is a sponge.

12. A process cartridge removably installable in an image forming apparatus, the process cartridge comprising:

an image carrying member to carry a toner image formed thereon;

at least one of a charging device, a cleaning device, and a development device formed integrally with the image carrying member; and the lubricant applicator according to claim 1 to apply the lubricant to a surface of the image carrying member.

13. An image forming apparatus, comprising:

an image carrying member to carry an electrostatic latent image formed on a surface thereof;

a latent image forming device to form an electrostatic latent image on the surface of the image carrying member;

a development device to develop the electrostatic latent image into a toner image;

a transfer device to transfer the toner image onto a recording medium; and the process cartridge according to claim 12.

14. A transfer unit, comprising:

a transfer device to transfer a toner image formed on an image carrying member;

a transfer member to carry the toner image transferred thereto; and the lubricant applicator according to claim 1 to apply the lubricant to a surface of the transfer member.

15. An image forming apparatus, comprising:

an image carrying member to carry an electrostatic latent image formed on a surface thereof;

a latent image forming device to form the electrostatic latent image on the surface of the image carrying member;

a development device to develop the electrostatic latent image into a toner image;

a transfer device to transfer the toner image onto a recording medium; and the transfer unit according to claim 14.

16. An image forming apparatus, comprising:

an image carrying member to carry an electrostatic latent image formed on a surface thereof;

a latent image forming device to form the electrostatic latent image on the surface of the image carrying member;

a development device to develop the electrostatic latent image into a toner image;

a transfer device to transfer the toner image onto a recording medium; and the lubricant applicator according to claim 1, to apply the lubricant to a surface of the image carrying member.

* * * * *